US008186910B2

(12) United States Patent
Smith

(10) Patent No.: US 8,186,910 B2
(45) Date of Patent: May 29, 2012

(54) UNIVERSAL METHOD AND APPARATUS FOR DEPLOYING FLYING LEADS

(75) Inventor: Ronald E. Smith, Friendswood, TX (US)

(73) Assignee: Deep Down, Inc., Channelview, TX (US)

( * ) Notice: Subject to any disclaimer, the term of this patent is extended or adjusted under 35 U.S.C. 154(b) by 256 days.

(21) Appl. No.: 12/535,653

(22) Filed: Aug. 4, 2009

(65) Prior Publication Data

US 2011/0030966 A1 Feb. 10, 2011

(51) Int. Cl.
*F16L 1/14* (2006.01)

(52) U.S. Cl. ..... 405/158; 405/171; 405/190

(58) Field of Classification Search ..... 405/158, 405/166, 171, 190; 166/338, 340, 342
See application file for complete search history.

(56) References Cited

U.S. PATENT DOCUMENTS

| | | | | |
|---|---|---|---|---|
| 6,223,675 | B1 * | 5/2001 | Watt et al. | 114/312 |
| 6,350,085 | B1 * | 2/2002 | Bath et al. | 405/154.1 |
| 6,402,428 | B1 * | 6/2002 | Morisi et al. | 405/158 |
| 6,796,261 | B2 * | 9/2004 | Colyer | 114/258 |
| 6,957,929 | B1 * | 10/2005 | Rachel et al. | 405/158 |
| 2005/0276665 | A1 * | 12/2005 | Entralgo et al. | 405/190 |

* cited by examiner

*Primary Examiner* — David Bagnell
*Assistant Examiner* — Benjamin Fiorello
(74) *Attorney, Agent, or Firm* — Samuel Digirolamo; Husch Blackwell LLP

(57) ABSTRACT

In one embodiment, the subsea deployment system may be used to install flying leads with integral buoyancy. In another embodiment, the subsea deployment system may be used to install flying leads with separate buoyancy modules. The installation sling assembly may be used with the subsea deployment system or with other systems to deploy flying leads subsea. The universal removable cartridge may be interchanged for use on a horizontal drive unit and a mud mat.

3 Claims, 24 Drawing Sheets

UNIVERSAL METHOD AND APPARATUS FOR DEPLOYING FLYING LEADS

BACKGROUND OF THE INVENTION

Flying leads are commonly used in the offshore oil and gas industry to connect two pieces of equipment located subsea. Flying leads may be hydraulic, electro-hydraulic, loose tube or jacketed. The flying leads shown in this patent application are jacketed. A flying lead is an elongate bundle of tubes and/or cables with a first cobra head assembly on one end of the elongate bundle and a second cobra head assembly on the other end of the elongate bundle, as is well known to those skilled in the art.

Several different companies produce flying leads and there are several different designs for the cobra heads. For example the cobra heads shown in FIGS. 1-20 are designed by FMC Corporation. These FMC cobra heads use separate buoyancy modules during subsea installation. Applicant makes no claim the design of the FMC cobra head. Deep Down, Inc., the assignee of this application, produces Moray® brand flying leads; some of which have an integral buoyancy module on each cobra head as shown in FIGS. 21-27.

There are at least two methods for deploying flying leads. The first method is over a lay chute from the stern of a ship. The second method is using a subsea deployment system. In the past, different types of apparatus were needed to practice each method.

A. First Method. Deep Down and others have used the first method for years to deploy flying leads. Most contractors use a vertical drive unit with a removable carousel when deploying flying leads over the stern mounted lay chute. These vertical drive units are well known to those skilled in the art. Deep Down developed a horizontal drive unit for use with a rapid deployment cartridge and a lay chute.

Using either a vertical or a horizontal drive unit, the flying lead goes over a stern mounted lay chute and is installed with the assistance of a ROV. A down line from the ship lowers the flying lead to the seafloor. Worldwide this stern mounted lay system is probably the most common way to install flying leads and is well known to those skilled in the art. The Deep Down rapid deployment cartridge was only compatible with the Deep Down horizontal drive unit; the rapid deployment cartridge was not compatible with any mud mat.

B. Second Method. Deep Down developed another type of subsea deployment system in approximately 2006 for installation of flying leads. This system used a custom designed cartridge that was not compatible with a horizontal drive unit. The flying lead was wound on the custom cartridge. This custom cartridge engaged a mud mat which was lowered over the side of the ship. Once on the seafloor, the flying lead was installed by a remote operated vehicle (ROV) with the assistance of a down line from the ship. There is a need for a universal system that can use either the first method or the second method, depending on the customer's requirements. There is a need for a universal apparatus that can deploy both flying leads with integral buoyancy and flying leads that have a separate buoyancy module.

SUMMARY OF THE INVENTION

In one embodiment, a removable universal cartridge, mud mat, slings and a pair of separate buoyancy modules may be used to deploy at least one flying lead as shown in FIGS. 1-20. In another embodiment, a removable universal cartridge, mud mat and slings may be used to deploy a flying lead with integral buoyancy, such as shown in FIGS. 21-27.

The cartridge of the present invention is called "universal" in part, because it may be used with any type of flying lead or cobra head, of which there are several. The cartridge is also called universal because it is the first to be compatible with both a horizontal power drive unit and a mud mat.

The removable universal cartridge used in the present invention can be used with a horizontal drive unit to deploy flying leads using the lay chute method described above and it can be used with a mud mat to deploy flying leads using the second method described above. In combination, the universal cartridge and mud mat used in the present invention can deploy Moray flying leads from Deep Down or flying leads from other vendors. In one embodiment, the present invention is a combination of several components, and is sometimes simply referred to as the "subsea deployment system".

To applicant's knowledge, the subsea deployment system is the first system that can deploy any brand of flying lead using either of the deployment techniques described above. To applicant's knowledge, the subsea deployment system is the first system that is compatible with both a horizontal drive unit and a mud mat. Applicant has also developed a unique installation sling assembly that makes it easier and faster to deploy flying leads in conjunction with the subsea deployment system or other deployment systems from other vendors.

BRIEF DESCRIPTION OF THE DRAWINGS

FIG. 16 B is an assembly drawing of one buoyancy sling assembly with a buoyancy module attached.

DETAILED DESCRIPTION OF THE INVENTION

Figure 1:
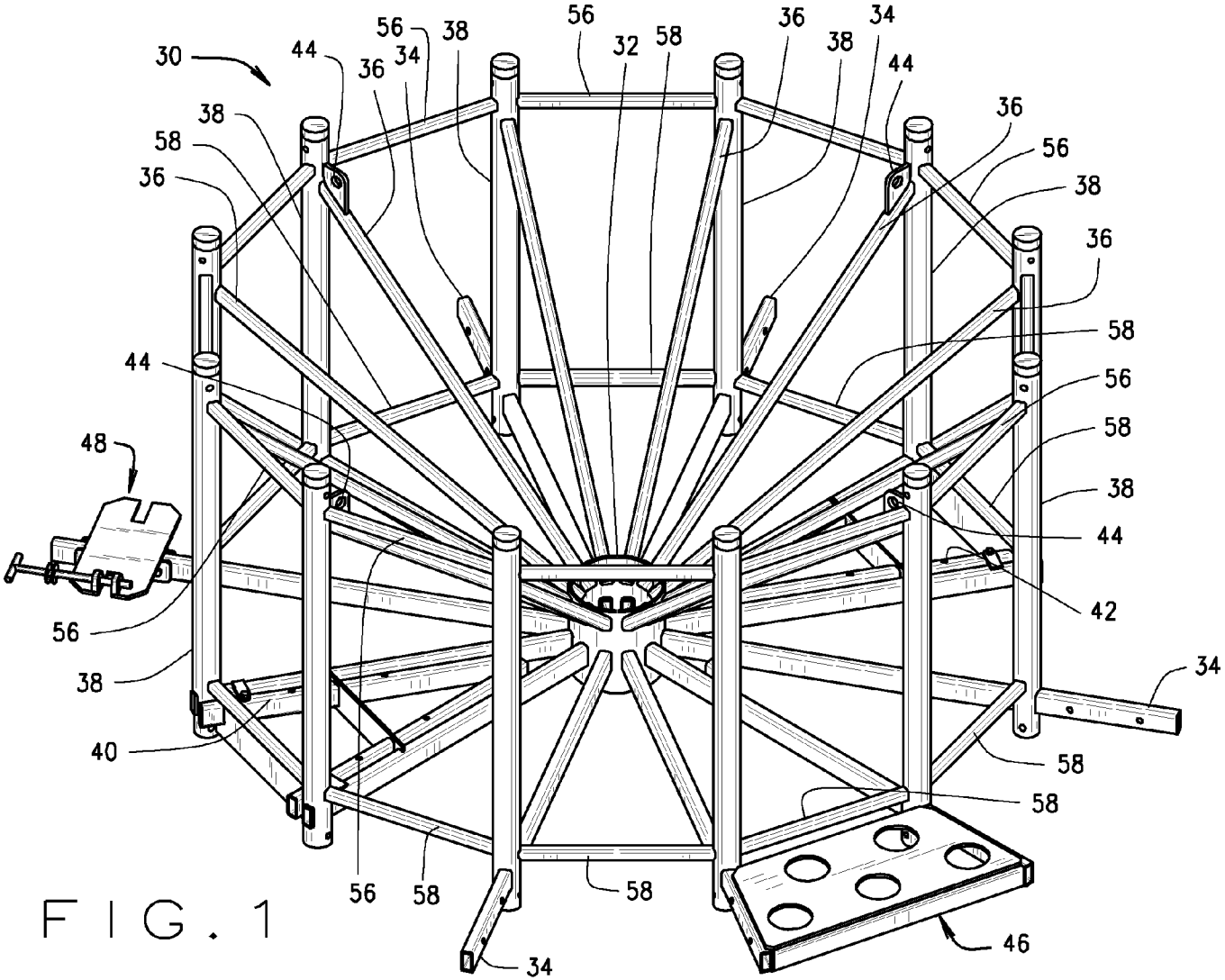
FIG. 1 is a perspective of an empty universal cartridge.
Figure 2:
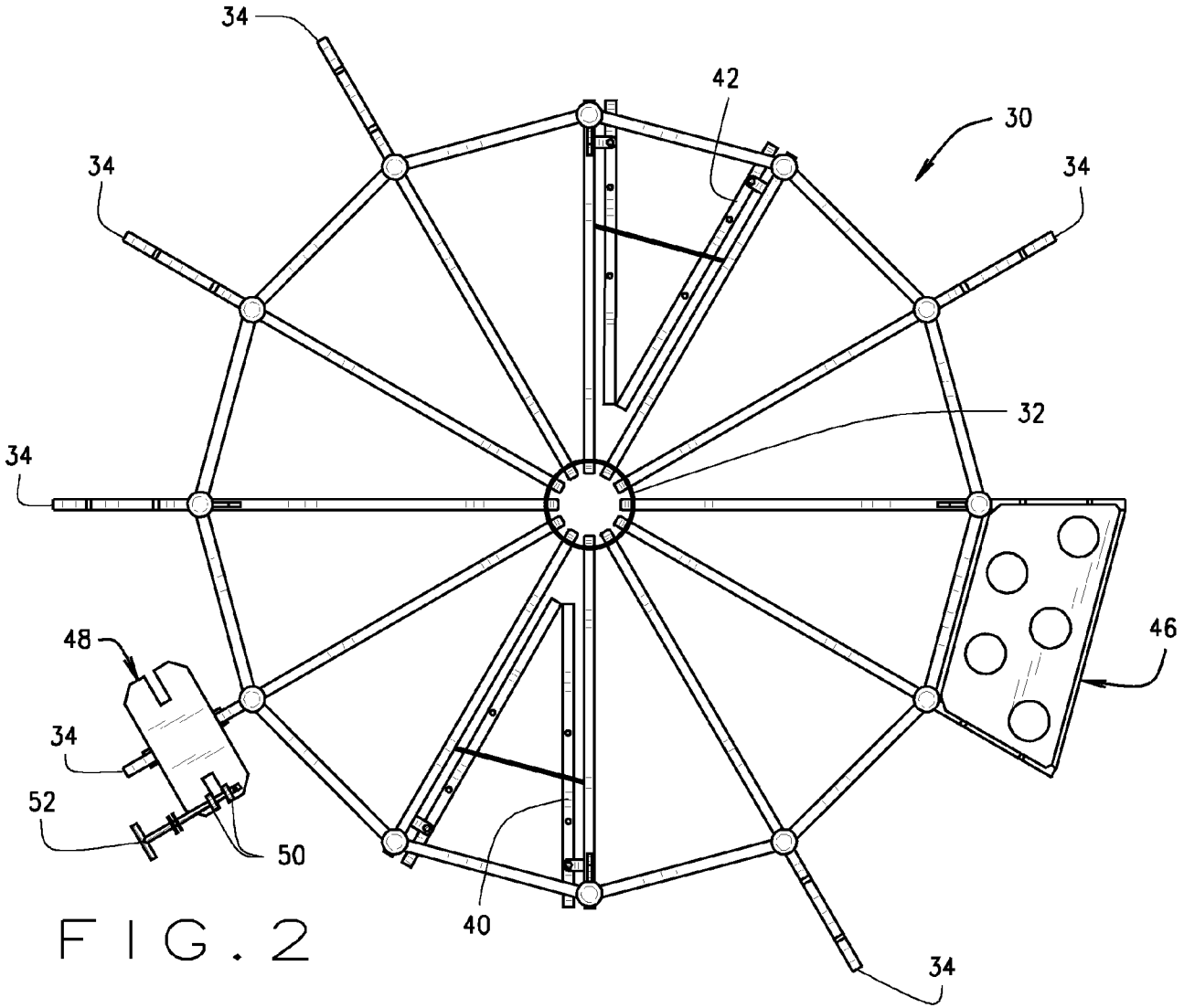
FIG. 2 is a plan view of the empty cartridge of FIG. 1.

Referring to FIGS. 1, 2, 3, 4 and 5 the universal removable cartridge is generally identified by the numeral 30. A hub 32 is centrally located in the middle of the universal removable cartridge. A plurality of fixed horizontal spokes 34 and a plurality of angled spokes 36 extend from the hub. Each fixed horizontal spoke and each angled spoke is joined by a plurality of uprights 38. In addition to the fixed horizontal spokes, there is a first retractable spoke assembly 40 and a second retractable spoke assembly 42. In FIG. 1, the first and the second retractable spoke assemblies are shown in the retracted position so the universal removable cartridge can be easily shipped on 18 wheel trucks over-the-road. Once ready for deployment subsea, the first and second retractable spoke assemblies are shifted to the extended position, not shown.

Figure 6:
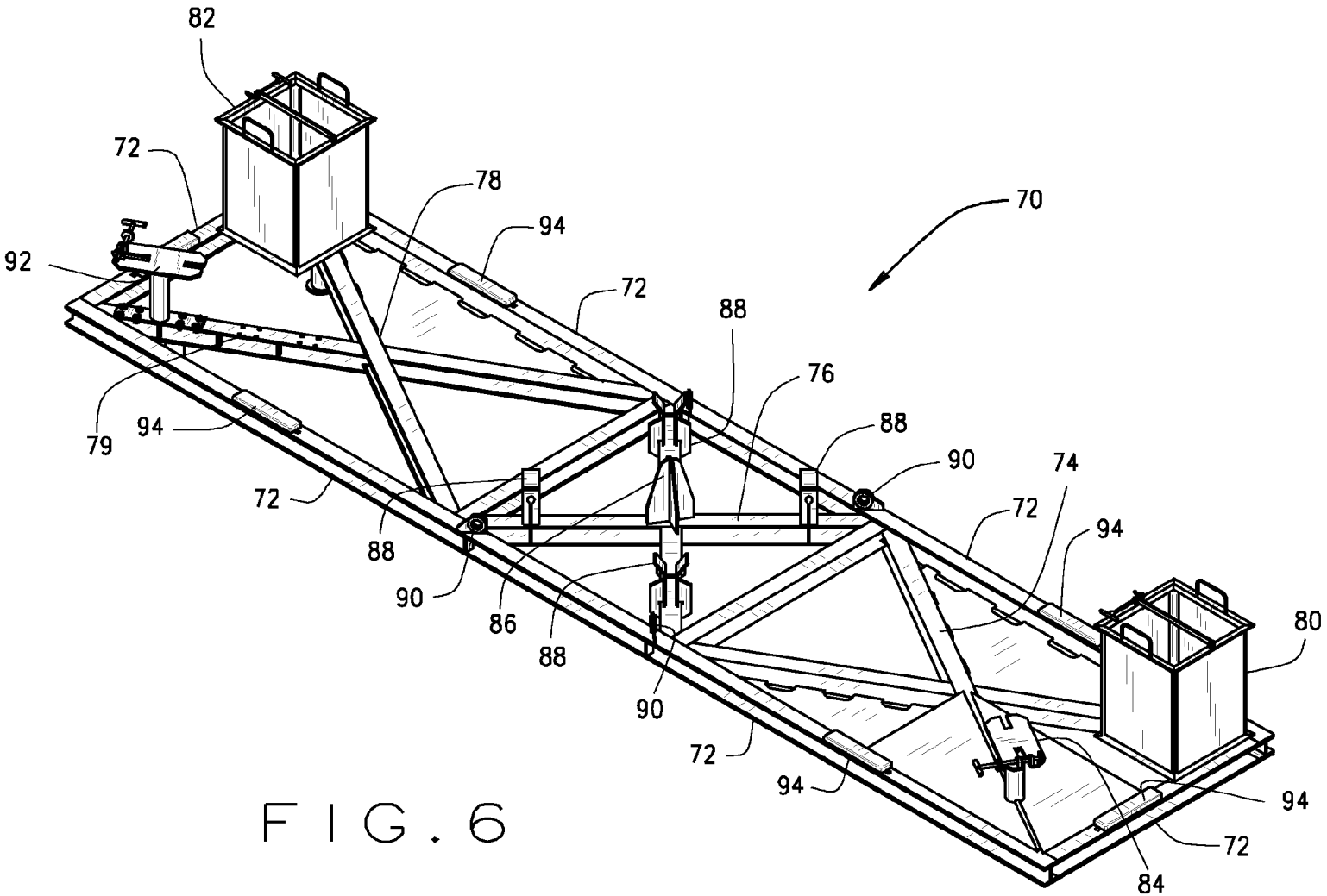
FIG. 6 is a perspective of a mud mat without a cartridge or buoyancy modules.
Figure 7:
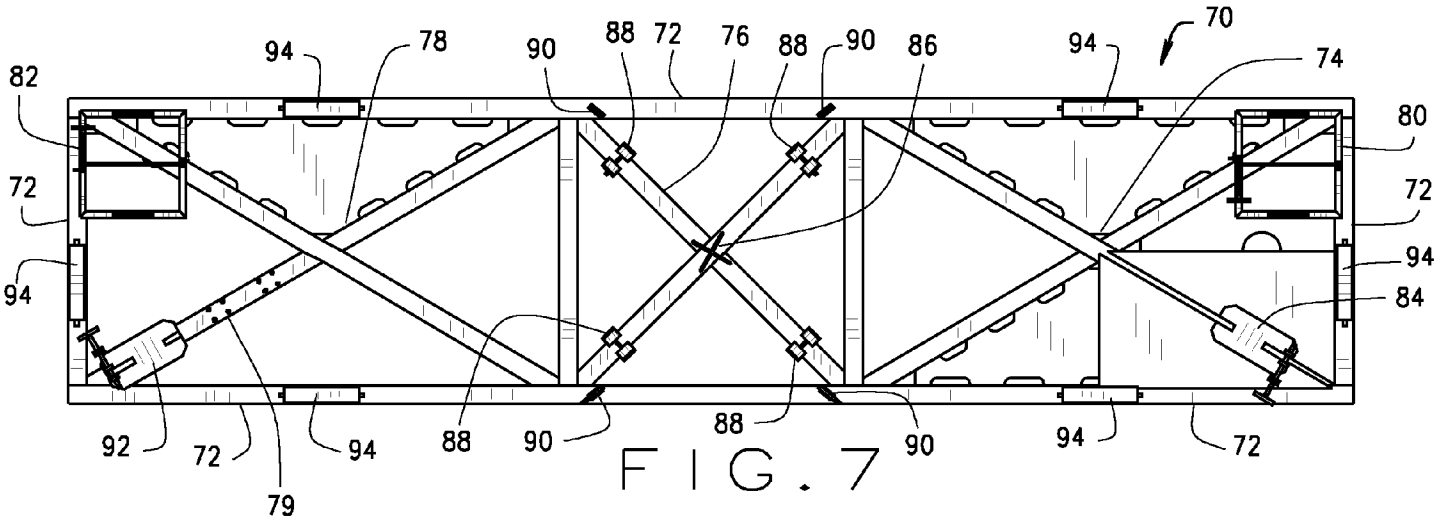
FIG. 7 is a plan view of the mud mat of FIG. 6.
Figure 8:
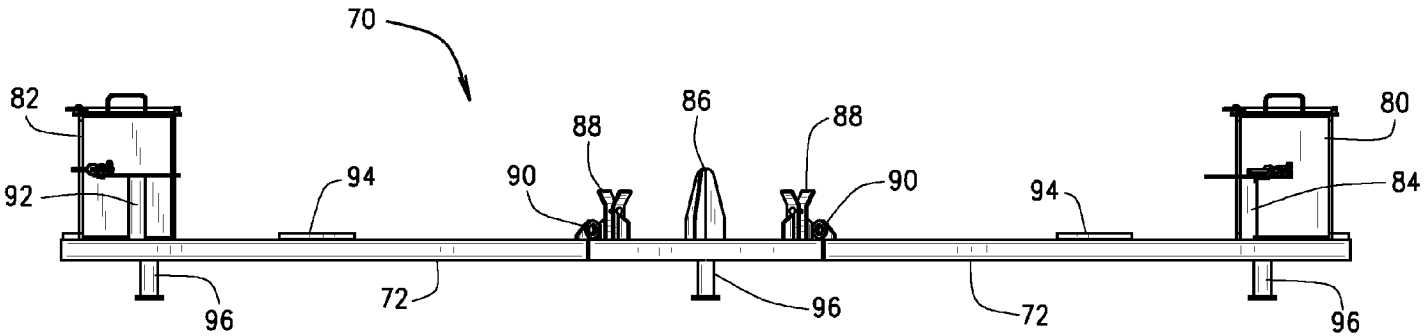
FIG. 8 is an elevation view of the mud mat of FIG. 6.

A plurality of lift eyes 44 are attached by welding or other suitable attaching means to the angled supports and the uprights. The lift eyes are used to move the universal removable cartridge around. For example they may be used to lift the universal removable cartridge on and off a horizontal drive unit, not shown, or on-and-off a mud mat, shown in FIG. 6.

Figure 5:
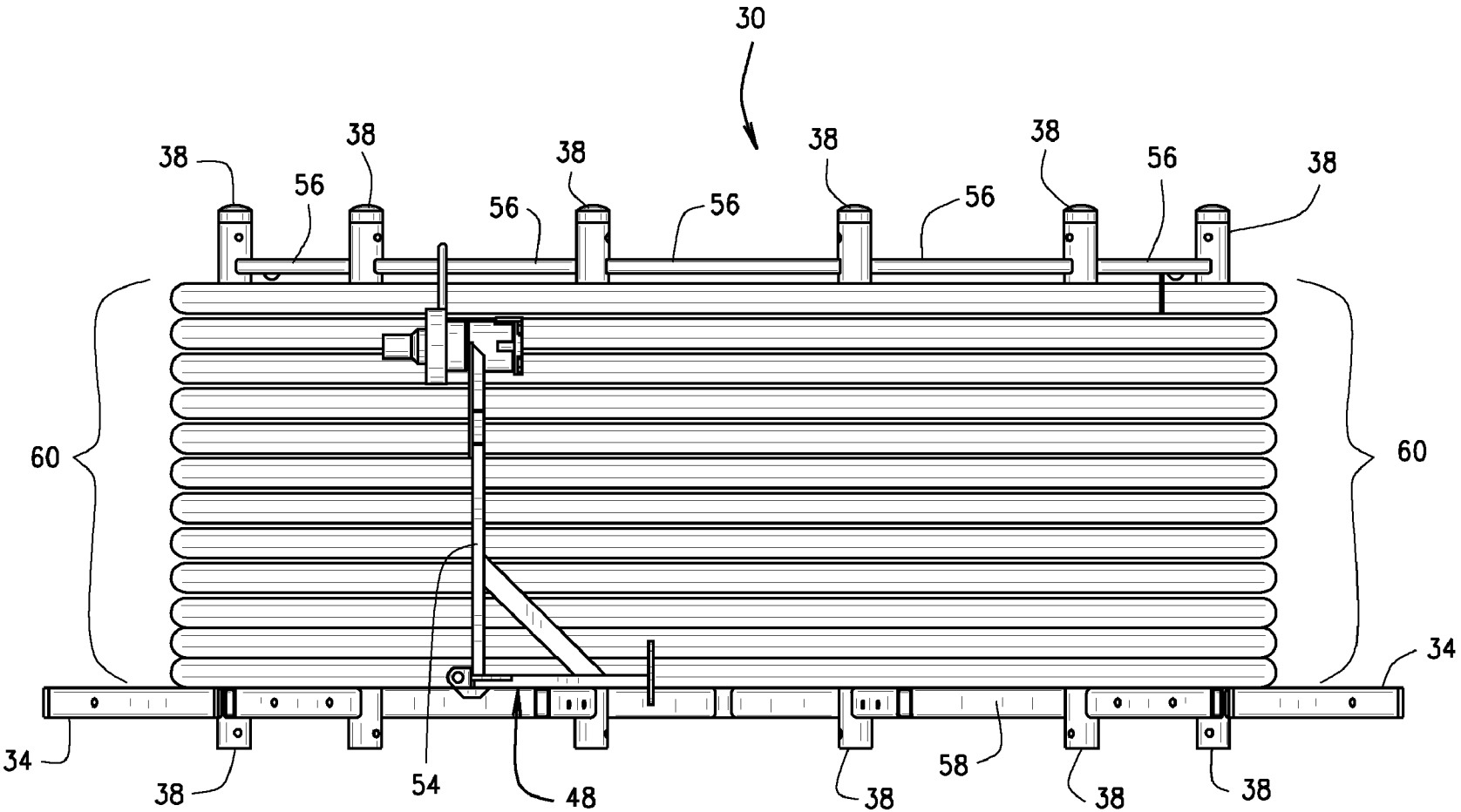
FIG. 5 is an elevation view of an FMC flying lead wound on the cartridge ready for transport to a ship.
Figure 11:
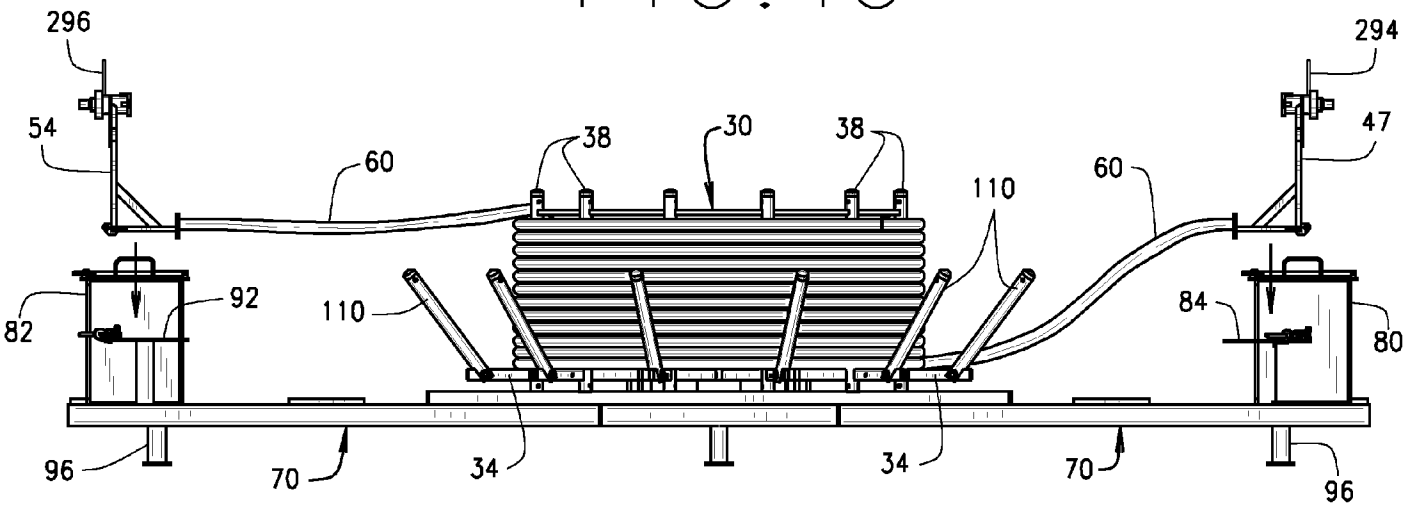
FIG. 11 is an elevation view of the cobra heads removed from the cartridge prior to installation on the porches of the mud mat. As shown, these porches will support an FMC flying lead. With slight modifications, these porches will support a flying lead from any vendor.

A fixed cobra support 46 is attached to two of the horizontal spokes. The first cobra head 47 is attached to the fixed cobra support 46. While the bundle 62, better seen in FIG. 5, of the flying lead 60 is being wound on the universal removable cartridge the first cobra head is often called the "first on". An adjustable cobra support 48 is attached to another horizontal spoke. The second cobra head 54 is attached to the adjustable cobra support for shipping as best seen in FIG. 5. While the flying lead is being wound on the universal removable cartridge, the second cobra head 54, better seen in FIG. 11, is often called the "second on". The universal removable cartridge may be used for flying leads having different lengths. When winding the flying lead on the universal removable cartridge, it is unknown exactly where the second cobra head will land. Therefore, the adjustable cobra support 48 may be moved to the other horizontal spokes 34 as needed to fit the length of the second cobra head.

A plurality of upper bars 56 and a plurality of lower bars 58 interconnect between the uprights adding strength to the overall apparatus. The universal removable cartridge 30 is sized and arranged to operatively connect with a horizontal drive unit, not shown or to lock on the mud mat of FIG. 6. When the flying lead is wound on the universal removable cartridge 30, as shown in FIG. 5, the combination is ready for transport to a dock for loading on a ship.

Figure 3:
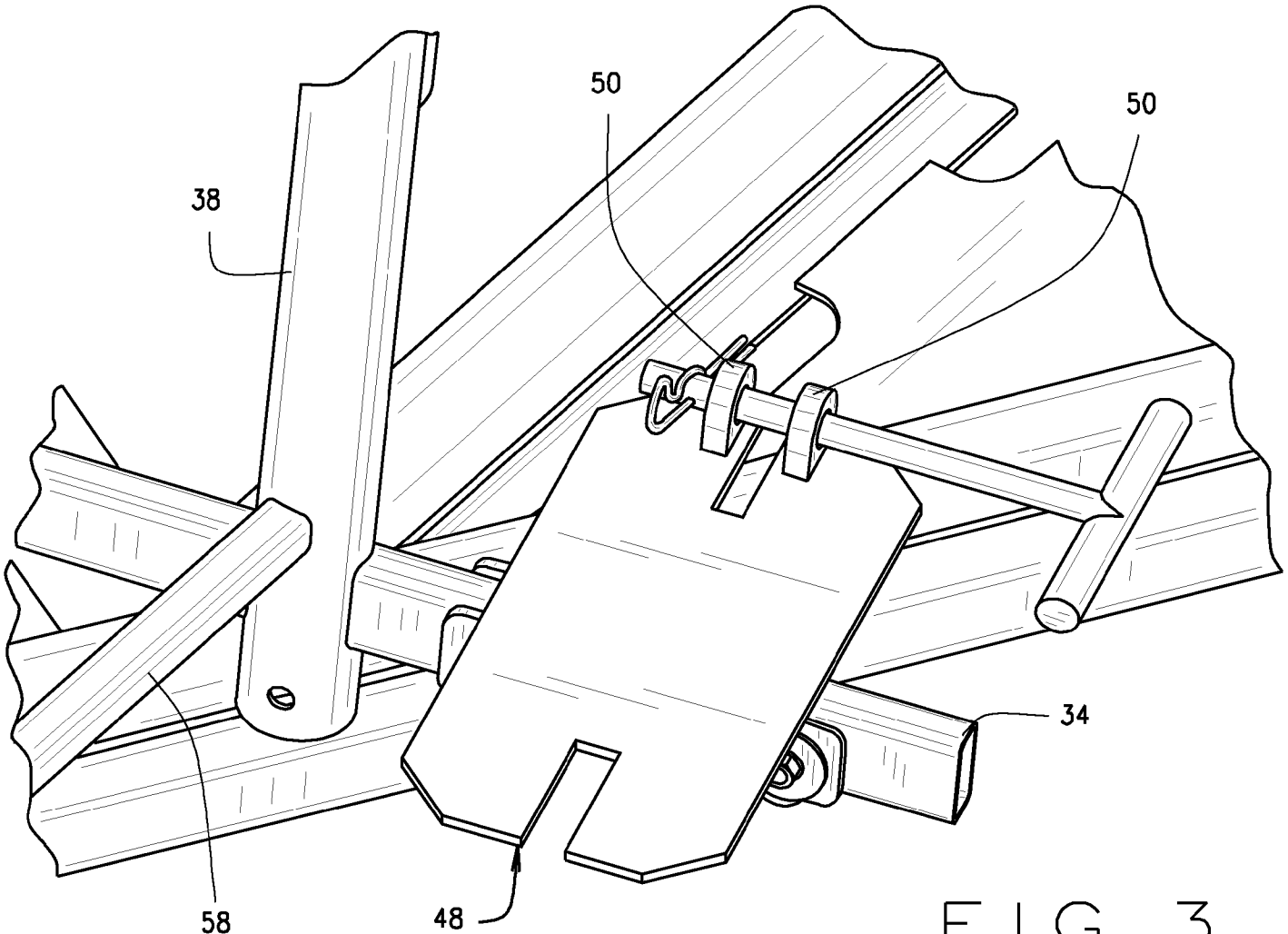
FIG. 3 is an enlargement of the removable support of FIGS. 1 and 2.
Figure 4:
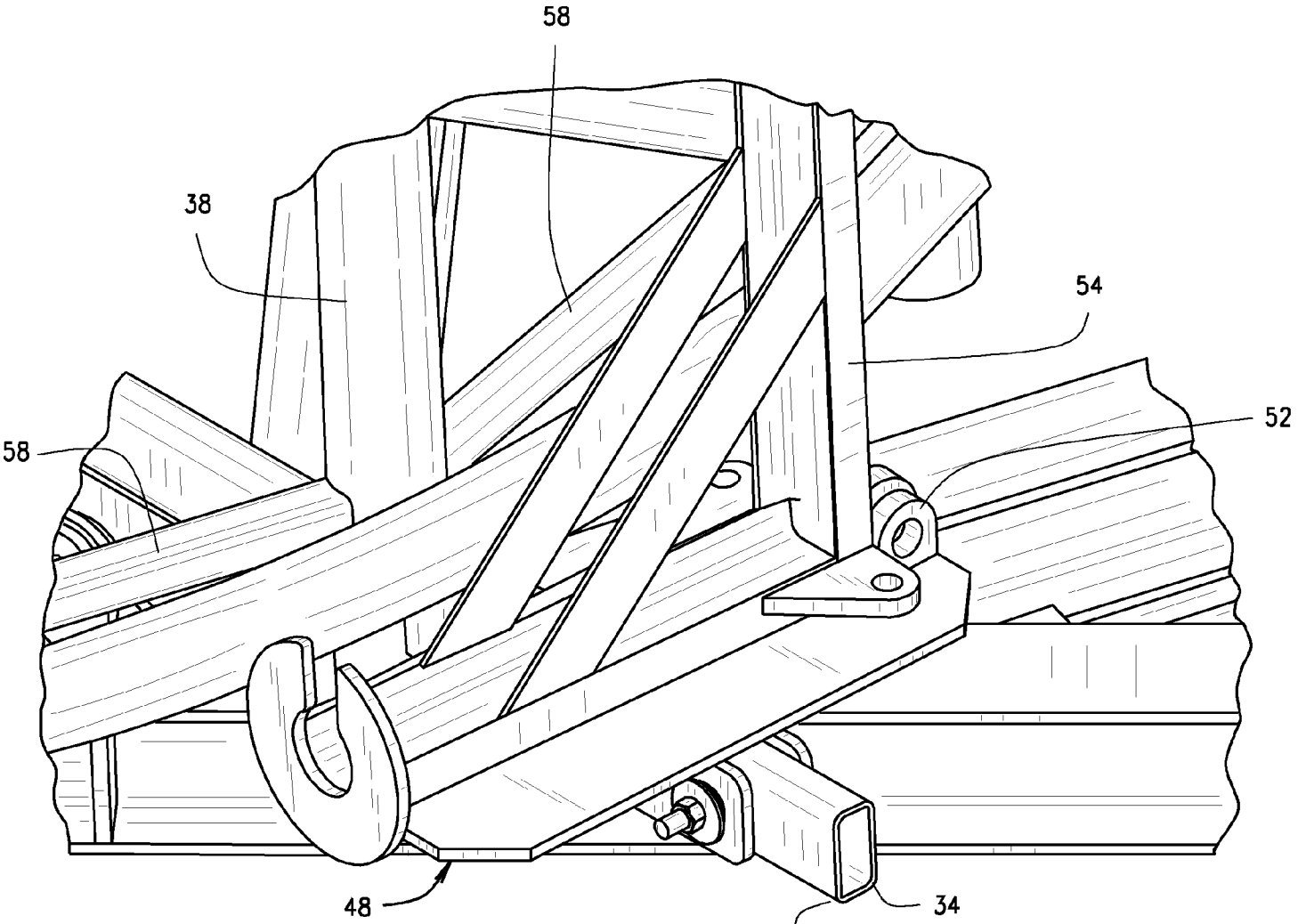
FIG. 4 is an enlargement of a portion of a cobra head assembly designed by FMC Corporation mounted on the removable support of FIG. 3. No claim is made to the FMC cobra head assembly. The removable support may be slightly modified to secure a cobra head assembly from any manufacturer.

Referring specifically to FIG. 3, a pair of opposing eyes 50 are welded to the adjustable cobra support. A threaded lock pin 52, not shown, passes through the opposing eyes and the second end off cobra head to attach the second cobra head 54 to the adjustable cobra support and the universal removable cartridge for shipment. As previously mentioned, the universal removable cartridge is compatible with cobra heads from any vendor. The cobra heads shown in these drawings are designed by FMC. Cobra heads from other vendors will have a different shape and with slight modifications to the fixed cobra support 64 and the adjustable cobra support 48, the universal removable cartridge can accommodate any of the other cobra head designs currently on the market. Similar slight modifications need to be made to the cobra head supports on the mud mat which will be described below.

Referring now to FIGS. 6, 7, 8, 9 and 10, the mud mat 70 is shown in perspective, plan and elevation view. The mud mat has a rectangular frame 72 with internal cross bracing. A first x-shaped cross brace 74 is located on one end of the frame. A central x-shaped cross brace 76 is located in the middle of the frame and a second x-shaped cross brace 78 is located on the opposite end of the frame. A first buoyancy module cage 80 is located on one corner of the mud mat and a second buoyancy module cage 82 is located on the other corner of the mud mat. This pair of cages each hold a buoyancy module, described below. A first porch 84 is mounted on one corner of the mud mat. The first porch is sized and arranged to engage and support the first cobra head 47, better seen in FIG. 11. A stabilizer pin 86 is located on the central x-shaped cross brace to engage the hub of the universal removable cartridge.

A means for securing the removable cartridge to the mud mat is provided. One example for securing the removable cartridge to the mud mat is a plurality of mud mat connectors 88 positioned on the central x-shaped cross braces which receive the horizontal spokes 34 of the removable cartridge. A bolt 98 fits through opposing eyes in each mud mat connector and each bolt is secured by a nut 100 to lock the horizontal spokes to the mud mat. Obviously the connectors could be placed on the removable cartridge and they could receive a portion of the mud mat. Other attaching types of apparatus may be a suitable means for securing the removable cartridge to the mud mat such as locking pins, not shown.

A plurality of mud mat eyes 90 are attached to the frame and are sized and arranged to engage the main sling, described below. A second adjustable porch 92 is located on the opposite corner of the mud mat to the first porch. The second adjustable porch is sized and arranged to engage and support the second cobra head 54, better seen in FIG. 11. A plurality of sacrificial anodes 94 are attached to the frame 72 to reduce corrosion, as is well known in the subsea art. A plurality of feet 96 are attached to the frame. These feet sit on the seafloor, when the mud mat is deployed.

Figure 9:
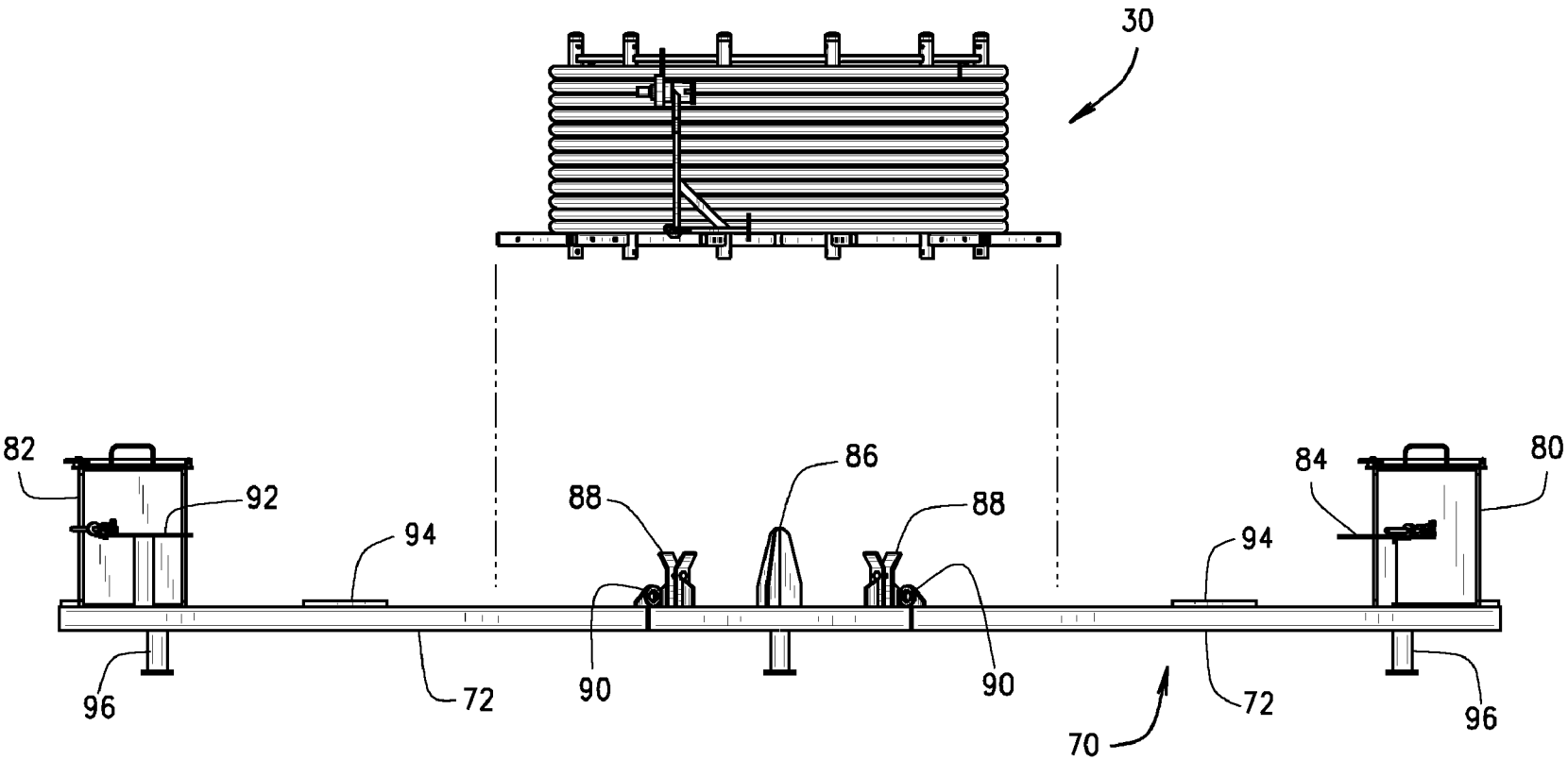
FIG. 9 is an elevation view of the universal cartridge prior to mounting on the mud mat.
Figure 10:
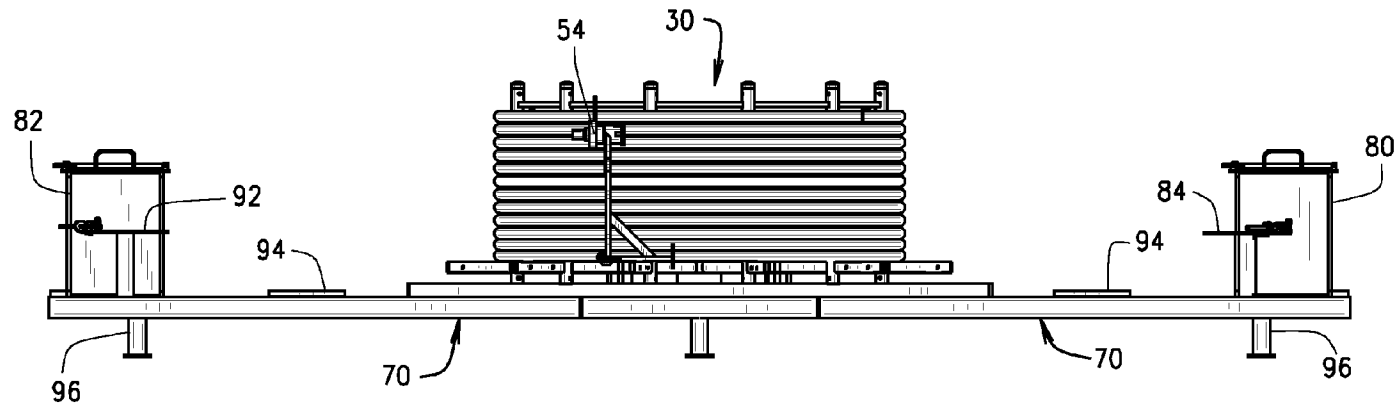
FIG. 10 is an elevation view of the subsea deployment system holding an FMC flying lead.

Referring now to FIGS. 9 and 10, the universal removable cartridge 30 is mounted on the mud mat 70. As previously described, the universal removable cartridge 30 may be attached and detached from the mud mat 70. The cartridge connectors, not shown, engage the mud mat connectors 88. Removable locking pins are then put in these connectors to lock the universal removable cartridge to the mud mat before it is deployed subsea. The stabilizer pin 86 engages the hub, not shown. In this fashion, the universal removable cartridge is properly mounted on the mud mat before it is deployed subsea.

Referring now to FIGS. 11, 12, 13 and 14, the universal removable cartridge 30 is locked to the mud mat 70 and is made ready to go overboard. The first cobra head 47 is removed from the fixed cobra support and is attached to the first porch 84. The second cobra head 54 is attached to the second adjustable porch 92. A plurality of angled supports 110 are attached to the outer end of each horizontal spoke 34. The angled supports are able to move through an angle of about 45°. This helps to avoid snags during subsea deployment and retrieval of a flying lead for repair or repositioning.

A means for removably attaching the second cobra head to the second porch is provided. A similar means for removably attaching the first cobra head to the first porch is also provided. One example of the means for removably attaching the second cobra head to the second porch is an H-shaped clevis 112 and release pins. The H-shaped clevis 112 includes a first eye 114, a second eye 116 and a third eye 118. A similar H-shaped clevis is used to secure the first cobra head 47 to its porch. A pull type release pin 120 passes through the second eye and attaches the clevis to the porch 92. A hole is provided in the end of the release pin 120.

The ROV operator will typically attach a means to prevent inadvertent or accidental removal of the pin 120. There are several different means to prevent inadvertent or accidental removal, including a tie wrap (zip-tie), a hair pin with monkey fist or a hair pin with monkey fist. In this drawing a hair pin 124 without the monkey fist is shown. The monkey fist is a knot on the end of a rope which makes it easy for the ROV to grab and pull the pin. The monkey fist and these different means to prevent inadvertent or accidental removal of the pull pin are well known to those in the industry. A ROV hair pin 124 prevents inadvertent or accidental removal of the pin 120. A screw type release pin 122 passes through the first eye and attached the clevis to the second cobra head 54. A bolt 126 passes through the third eye and attaches the clevis to a shackle 130. A nut 128 threadably attaches to the other end of the bolt. A master link 132 attaches to the shackle 130. The installation sling assembly attaches to the master link 132 as will be described below. A D-shaped handle is affixed to the top of the second cobra head 54, better seen in FIG. 18. Another D-shaped handle is affixed to the top of the first cobra head 47, better seen in FIG. 18. Other attaching apparatus may be a suitable means for removably attaching each cobra head to the porch.

Figure 15:
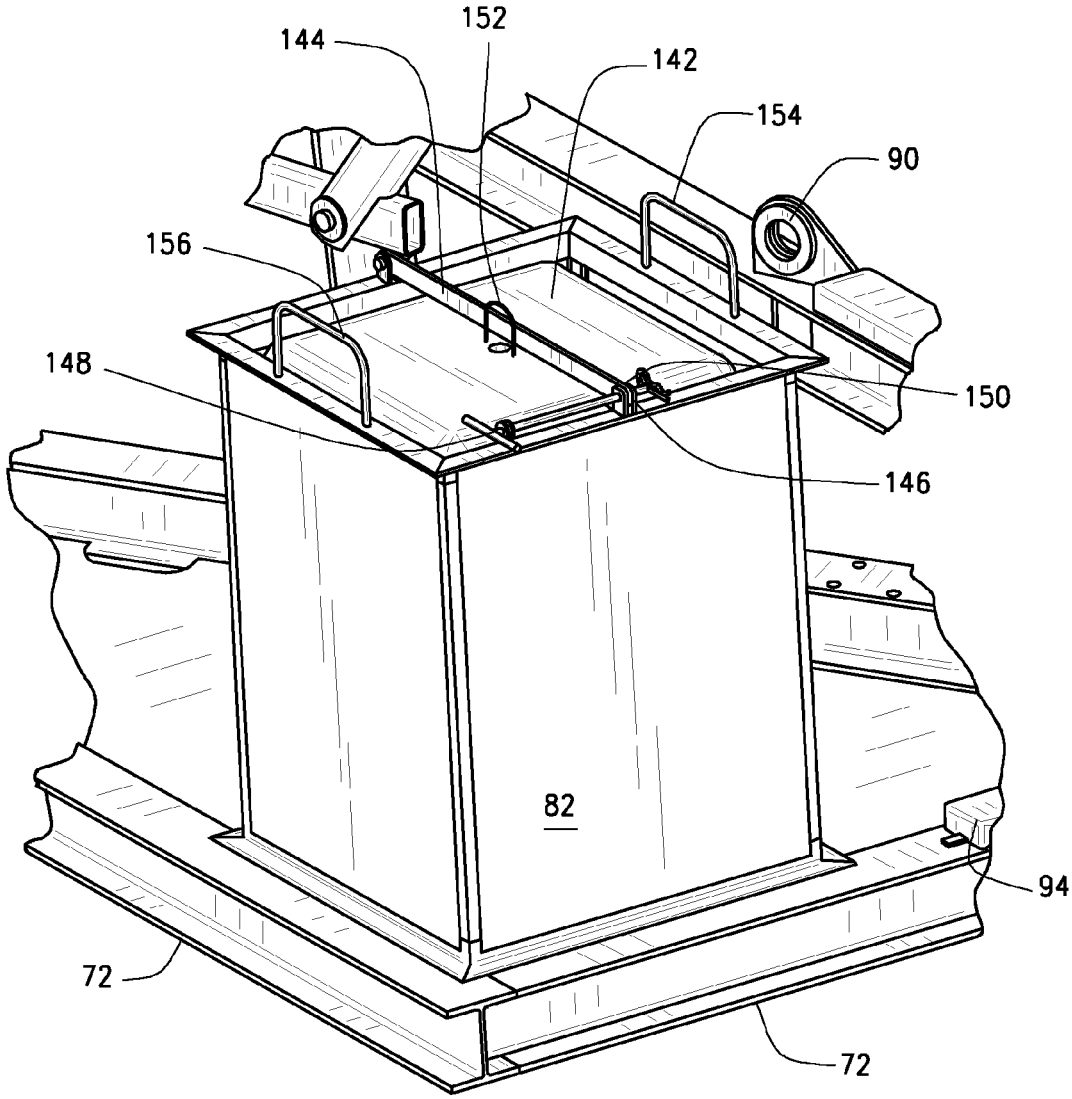
FIG. 15 is an enlargement of a second cage and a second buoyancy module, prior to connection of the buoyancy sling assembly.

FIG. 15 is an enlargement of the second buoyancy cage 82 which holds a second buoyancy module 142. A means for releasing each buoyancy module from each cage is provided. On example of the means for releasing a buoyancy module is an articulated latch 144 and a catch 146 secured by a pull pin 148. The pull pin is further secured against accidental opening by a ROV hair pin 150. A buoyancy module eye 152 is attached to the second buoyancy module. A first handle 154 is attached to the second buoyancy cage 82. A second handle 156 is attached to the opposite side of the second buoyancy cage 82. Other latches may be a suitable means for releasing each buoyancy module from each cage.

Figure 16A:
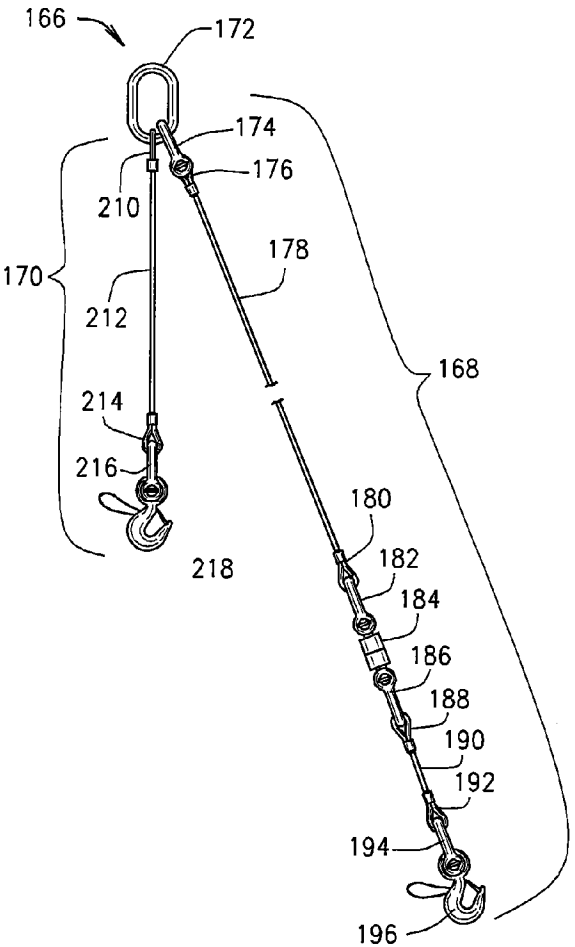
FIG. 16 A is an assembly drawing of the installation sling assembly.
Figure 16B:
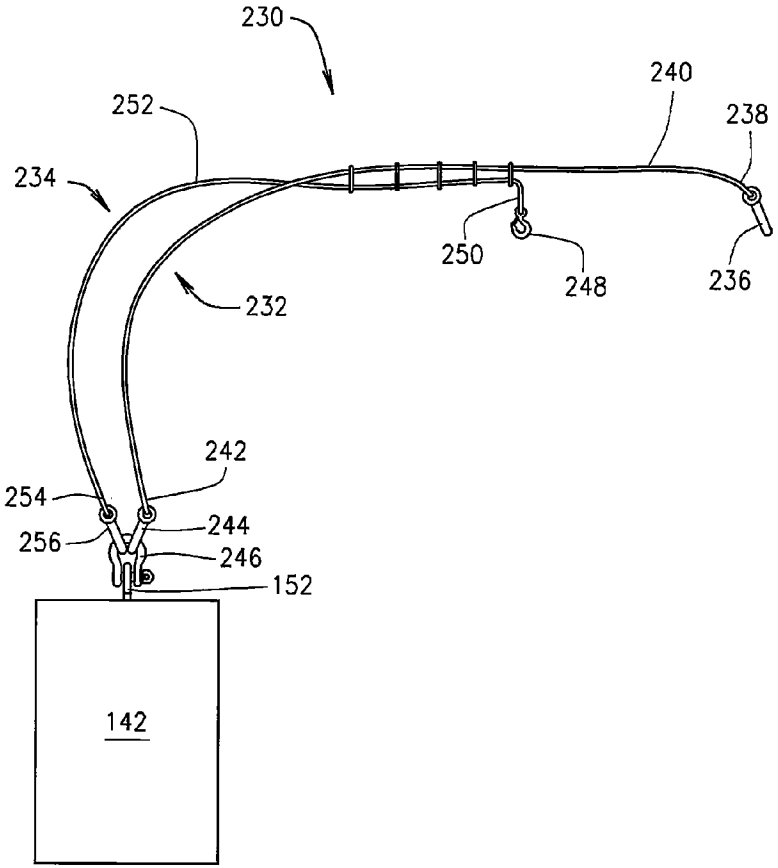

Referring to FIG. 16 A, an installation sling assembly is generally identified by the numeral 166. Referring to FIG. 16 B, a buoyancy sling assembly is generally identified by the numeral 230 and a buoyancy module 142 is attached to the buoyancy sling assembly 230. Referring back to FIG. 16 A, the installation sling assembly 166 has a long leg identified by the bracket 168 and a short leg, identified by the bracket 170, both of which are connected to a master link 172. The long leg includes a shackle 174 connected to a thimble-eye 176, connected to a cable 178, connected to a thimble-eye 180, connected to a shackle 182 connected to a swivel 184, connected to a shackle 186, connected to a thimble-eye 188, connected to a cable 190, connected to a thimble-eye 192, connected to a shackle 194 which is connected to a ROV hook 196. The short leg includes a thimble eye 210, connected to a cable 212, connected to a thimble-eye 214 connected to a shackle 216, connected to a ROV hook 218. It is understood that there are numerous ways to assembly these slings. One important feature is that the long leg has a swivel which is capable of supporting the full weight of the flying lead while it is vertical in the water column. The purpose of the swivel is to allow the flying lead to rotate in the water column without twisting the down line.

Referring to FIG. 16 B, the buoyancy sling assembly 230 includes a long leg, sometimes referred to as the first leg, generally identified by the numeral 232 and a short leg, sometimes referred to as the second leg, generally identified by the numeral 234. The long leg includes a ROV hook 236 which attaches to the D-shaped handle on the top of the cobra head cobra head, better seen in other views. The ROV hook 236 is connected to a sewn-eye 238 which connects to a nylon strap 240, which connects to a sewn-eye 242, which connects to a shackle 244, which connects to another shackle 246, which connects to buoyancy module eye 152. The short leg includes a ROV hook 248 connected to a thimble-eye 250, connected to a nylon strap 252, connected to a sewn-eye 254, connected to a shackle 256 which connects to the shackle 246 which connects to the buoyancy module eye 152, better seen in FIG. 15.

Figure 17:
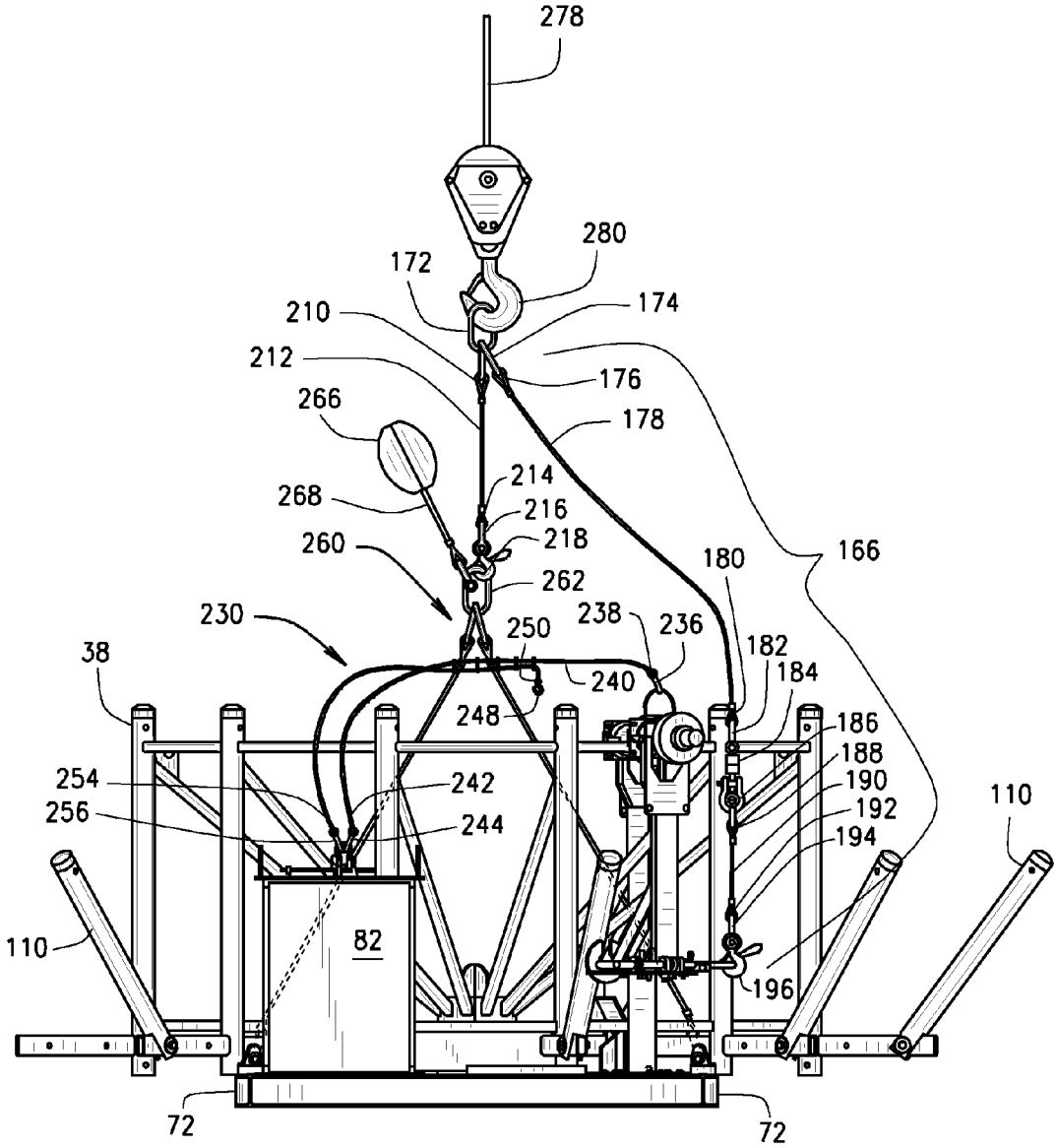
FIG. 17 is an elevation view of the subsea deployment system. The down line and ROV hook are attached to the master link. The first off cobra head assembly is mounted on its porch. The bundle for the flying lead has been omitted to better illustrate the apparatus.
Figure 18:
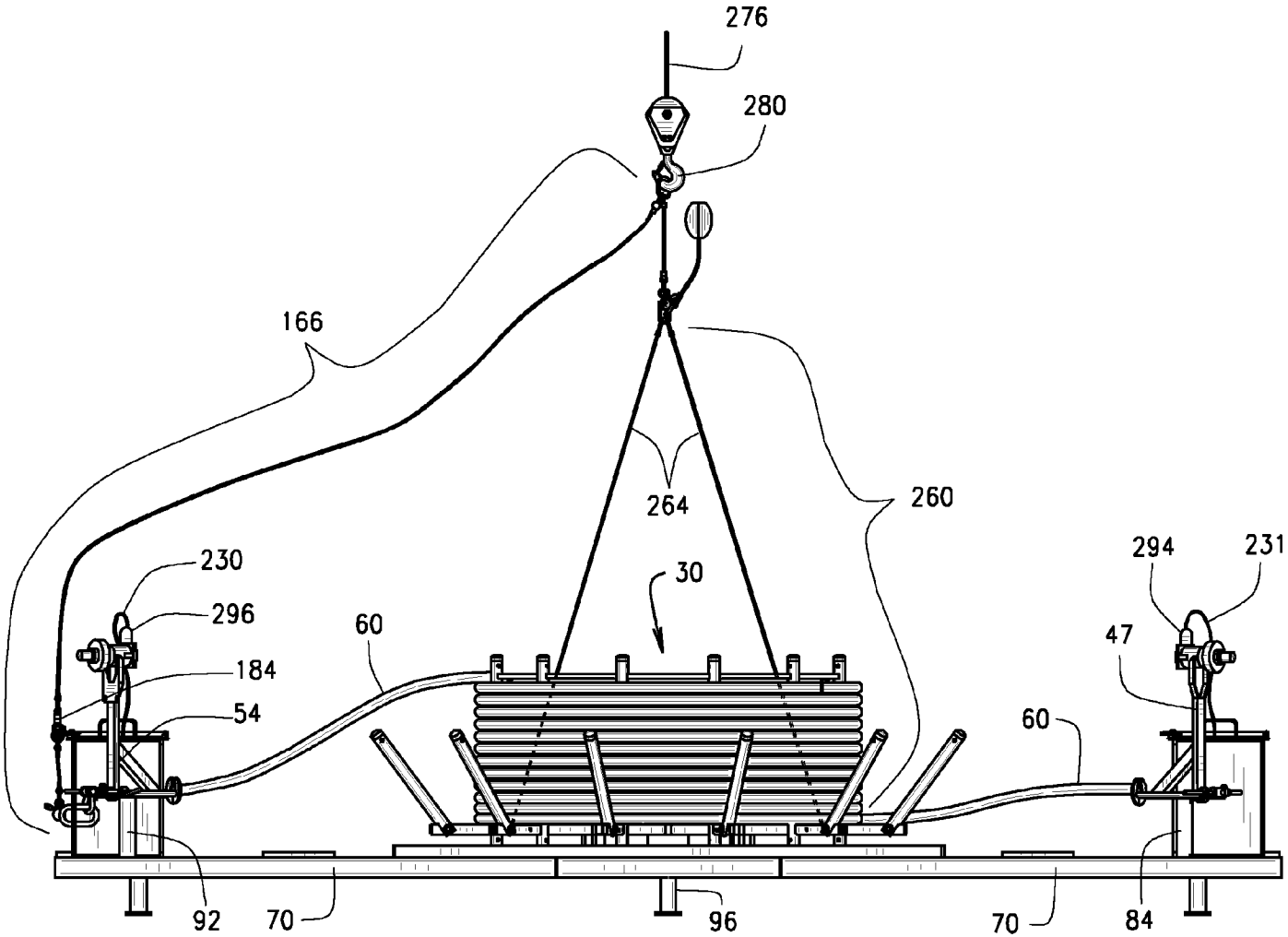
FIG. 18 is an elevation view of FIG. 17 from another angle, except the bundle has been added to better illustrate the subsea deployment system, just prior to going overboard.

Referring now to FIGS. 17 and 18, a down line 276 runs from the ship to a down line ROV hook 280. The down line and ROV hook 280 connect to the master link 172 of the installation sling assembly generally identified by the bracket 166. The short leg of the installation sling assembly connects to the mud mat link 262 on the mud mat sling assembly, generally identified by the bracket 260. In combination, the down line 276, the down line ROV hook 280, the installation sling assembly 166, and the mud mat sling assembly 260 are used to raise and lower the mud mat and cartridge from the deck of a ship to and from the seafloor.

Figure 20:
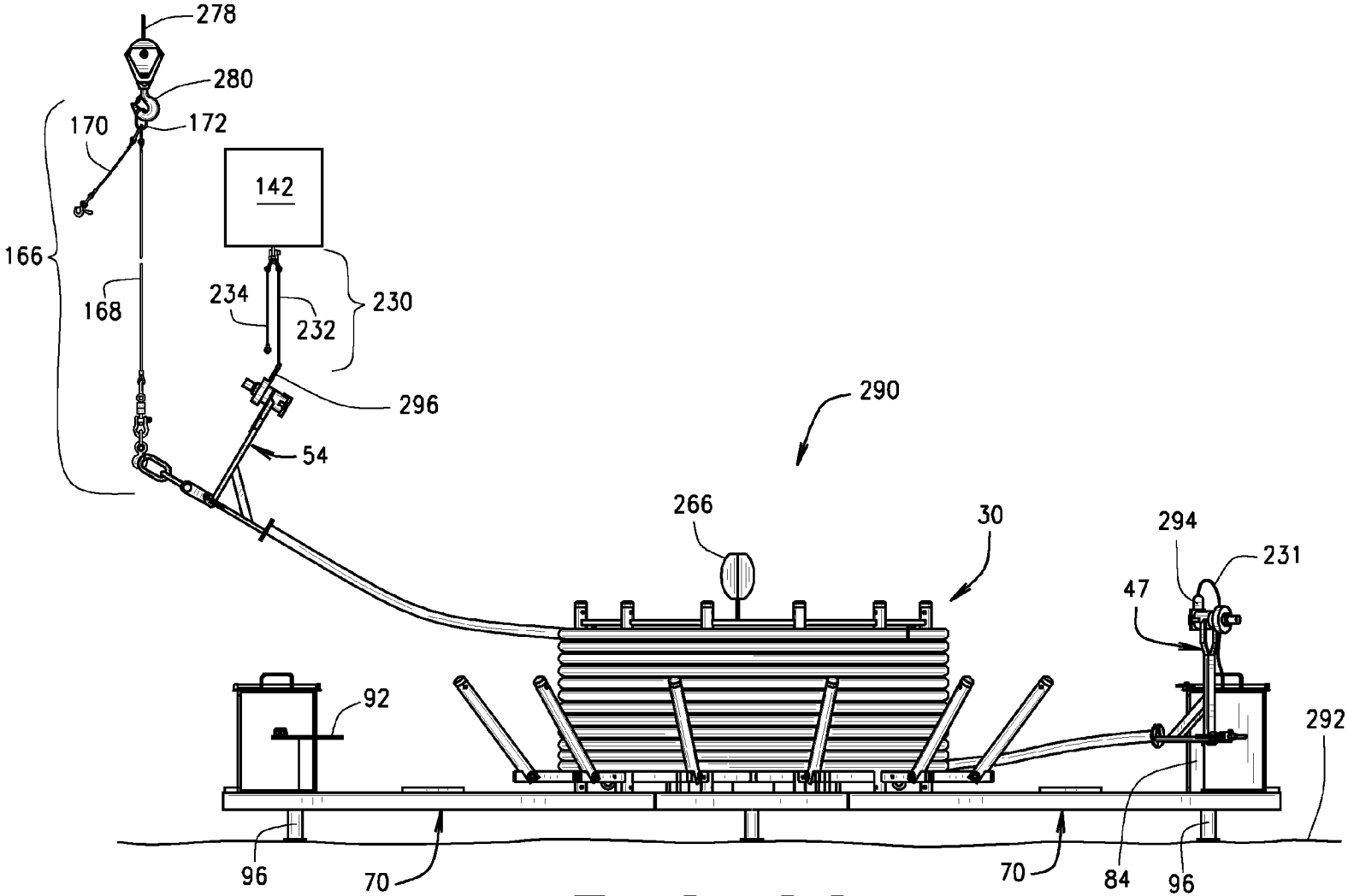
FIG. 20 is an enlarged perspective of a cobra head with integral buoyancy strapped to an adjustable porch on the universal cartridge. The bundle has been omitted to make the drawing easier to read.

The mud mat sling assembly 260 includes a mud mat link 262, connected to a plurality of cables 264 which connect to the plurality of mud mat eyes 90, better seen in FIG. 1. The mud mat sling assembly 260 further includes a buoyancy module 266 connected by a cable to the master link 262. The purpose of the buoyancy module 266 is to float slightly above the cartridge as shown in FIG. 20. This makes it easier for the ROV to retrieve the master link 262 when it is time to lift the mud mat and empty cartridge from the seafloor back to the ship. The buoyancy module 266 of the mud mat sling assembly is shown in an upright position which is the way it looks underwater; but, above the water, this buoyancy module actually hangs downward due to the force of gravity. The bundle for the flying lead has been omitted from FIG. 17 to better reveal the structure of the apparatus and has been added to FIG. 18 to give a better overall view of this apparatus, just before it goes overboard from the ship.

Figure 19:
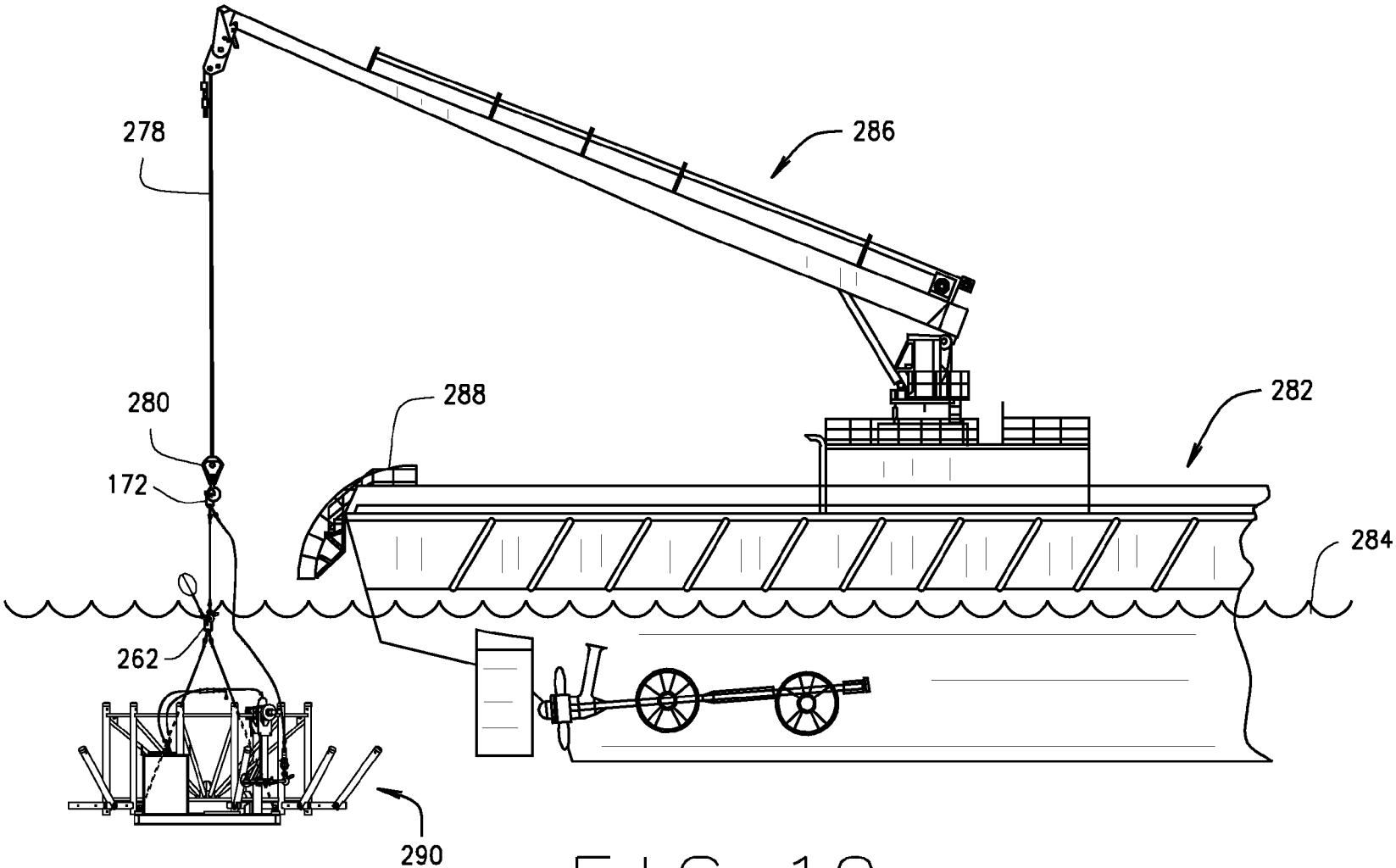
FIG. 19 is an elevation view of the subsea deployment system going overboard supported by the down line from the ship. The bundle for the flying lead has been omitted from this figure to better illustrate the apparatus.

FIG. 19 is an elevation view of the subsea deployment system going overboard supported by the down line 278 from the ship 282. The down line 278 connects to a down line ROV hook 280 from the ship 282. The ship has a crane 286 which can lower and raise the down line 278 and the down line ROV hook 280. The ship floats on the surface of water 284. The ship is equipped with an installation chute 288 which is an apparatus used in the first method for deploying flying leads, discussed at the beginning of this application. In one embodiment, the present invention is a combination of the removable universal cartridge, the mud mat, the mud mat sling assembly, the installation sling assembly, the pair of buoyancy modules and the pair of buoyancy sling assemblies for deployment of at least one flying lead subsea; this system is generally identified by the numeral 290. In FIG. 19, the system for deploying flying leads 290 has been lifted overboard from the ship and is about to be lowered to the seafloor.

FIG. 20 is an elevation view of the system 290 positioned on the seafloor 292. In this view, the mud mat sling assembly 260 has been disconnected from the installation sling assembly, generally identified by the bracket 166 and the second cobra head 54 has been released from its adjustable porch 92. The down line 278 from the ship "pays in" which means it is raised from the seafloor to hold the flying lead vertically in the water column which will be described in greater detail in the installation procedures below. The second cobra head 54 is called "first off" in the industry because it is the first taken off of the cartridge, subsea.

As previously mentioned, the universal removable cartridge 30 and mud mat 70 may be used with any type of cobra head design including those with separate buoyancy modules and those with integral modules. The preceding FIGS. 1-20 describe a first cobra head 47 with a separate buoyancy module 140 and a second cobra head 54, with a separate buoyancy module 142.

The following FIGS. 21-27 describe cobra heads with integral buoyancy. As previously mentioned, the universal removable cartridge 30 will hold cobra heads with integral buoyancy with minor modifications to the adjustable support 48. As previously mentioned, the mud mat 70 is compatible with cobra heads with integral buoyancy with a) minor modifications the first fixed porch 84 and means for removably attaching the first cobra head to the first fixed porch 84 and b) minor modifications to the second adjustable porch 92 and means for removably attaching the second cobra head to the second adjustable porch 92.

Figure 21:
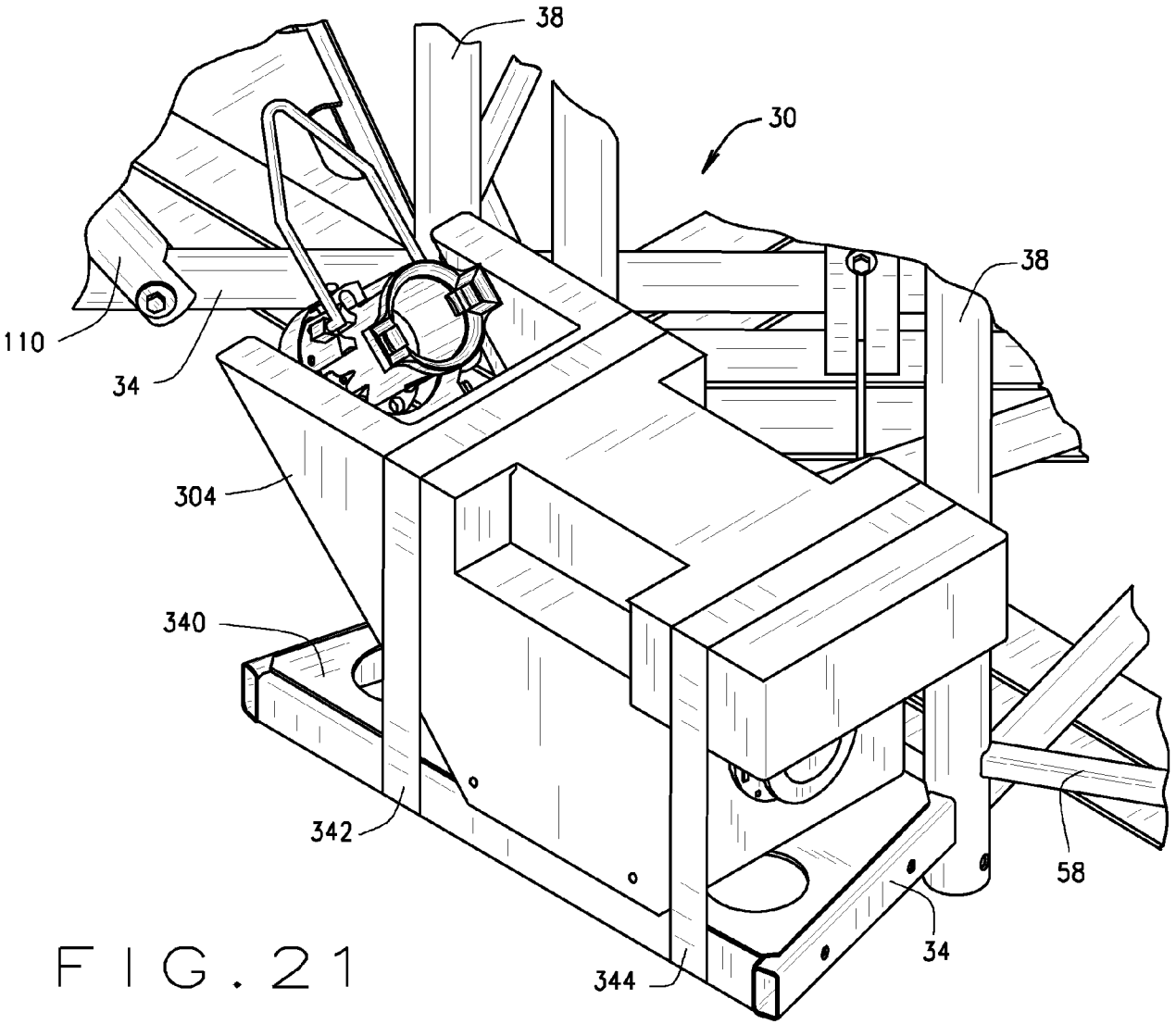
FIG. 21 is an elevation view of the subsea deployment system while resting on the sea floor. The first off cobra head assembly is being raised by the down line from the ship, used to pull the bundle off the cartridge, prior to raising the bundle in the water column.

FIG. 21 is an enlarged perspective of a cobra head with integral buoyancy 304 strapped to an adjustable support 340 on the universal cartridge 30. The bundle has been omitted to make the drawing easier to read. The cobra head with integral buoyancy 304 is the last end on the universal cartridge 30. The adjustable support 340 has been modified from the adjustable porch 48 in FIG. 1 because the cobra head with integral buoyancy 304 is shaped differently from the cobra head 54 in FIG. 4. These minor modifications allow the removable cartridge to receive cobra heads from different vendors with different designs. The removable cartridge still needs a fixed support 46 for the first on cobra head and an adjustable support for the second end on cobra head. In FIG. 21, the cobra head with integral buoyancy 304 is held in place on the by a first strap 342 and a second strap 344 on the adjustable cobra support 340. After the removable cartridge 30 has been mounted on the mud mat 70, the straps 342 and 344 are removed the second cobra head with integral buoyancy 304 is mounted on the second porch 84 as shown in the next figure.

Figure 22:
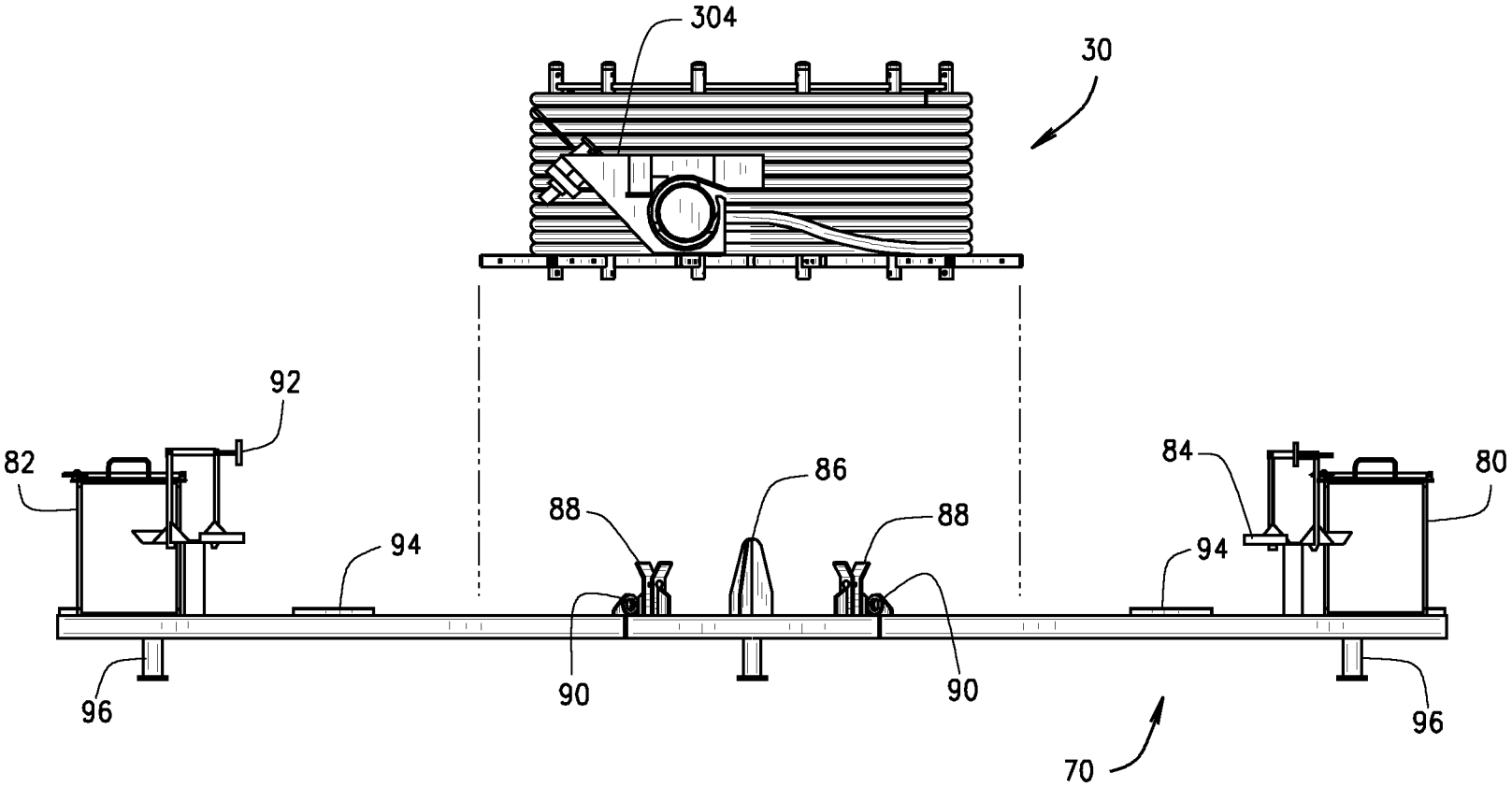
FIG. 22 is an elevation view of the universal cartridge prior to mounting on the mud mat. In this view, the flying lead has an integral buoyancy system.

Referring now to FIG. 22, the universal removable cartridge 30 is pictured above the mud mat 70. In this view, the second cobra head with integral buoyancy 304 is mounted on the cartridge, which is being lowered onto the mud mat 70 as indicated by the arrows. The first buoyancy cage 80 and the second buoyancy cage 82 are shown on the mud mat, although they are not needed because the cobra heads in this and following figures have integral buoyancy. However, for the mud mat 70 to function with cobra heads of different designs, the buoyancy cages are present.

In order to accommodate cobra heads with integral buoyancy, a) the first porch 84 has been modified to receive the first cobra head with integral buoyancy 302, better seen in following figures and b) the second porch 92 has been modified to receive the second cobra head with integral buoyancy 304. These modifications will be described in detail below.

Figure 23:
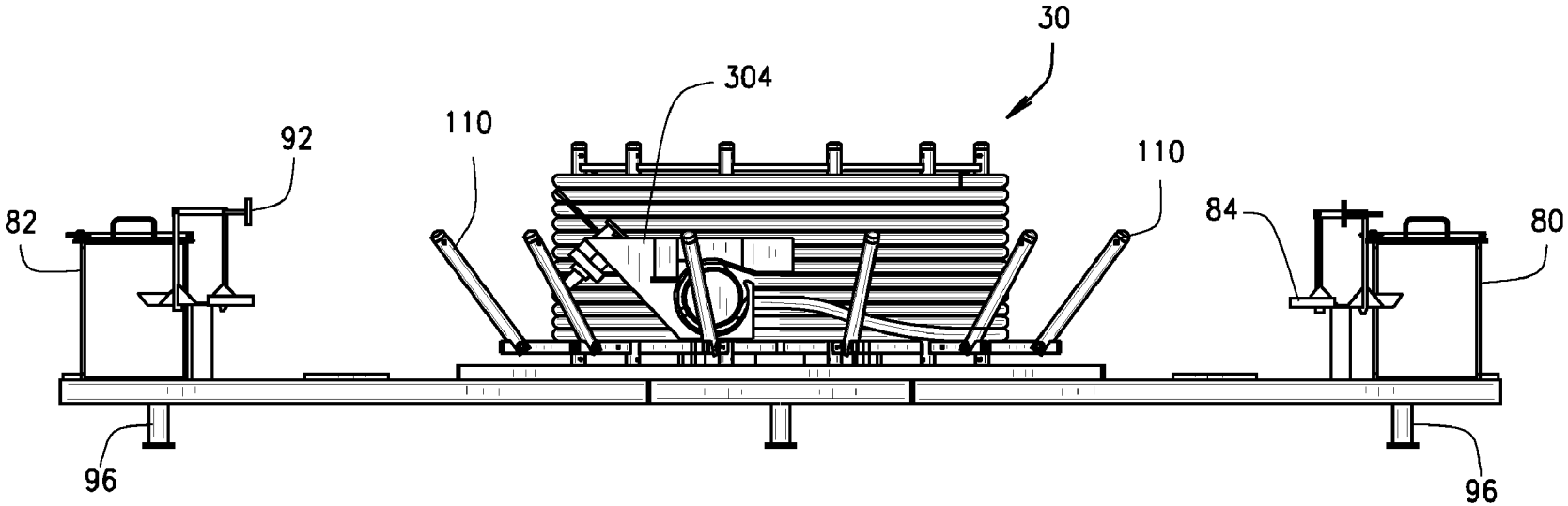
FIG. 23 is an elevation view of the subsea deployment system holding a flying lead with an integral buoyancy system.

FIG. 23 is a perspective view of the cartridge 30 attached to the mud mat 70. The first cobra head with integral buoyancy 302 will be attached to the first porch 84 and the second cobra head with integral buoyancy 304 will be removable attached to the second adjustable porch 92.

Figure 12:
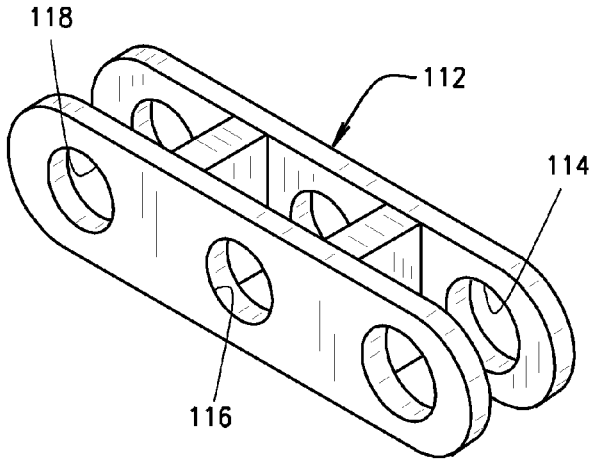
FIG. 12 is a perspective of a clevis.
Figure 13:
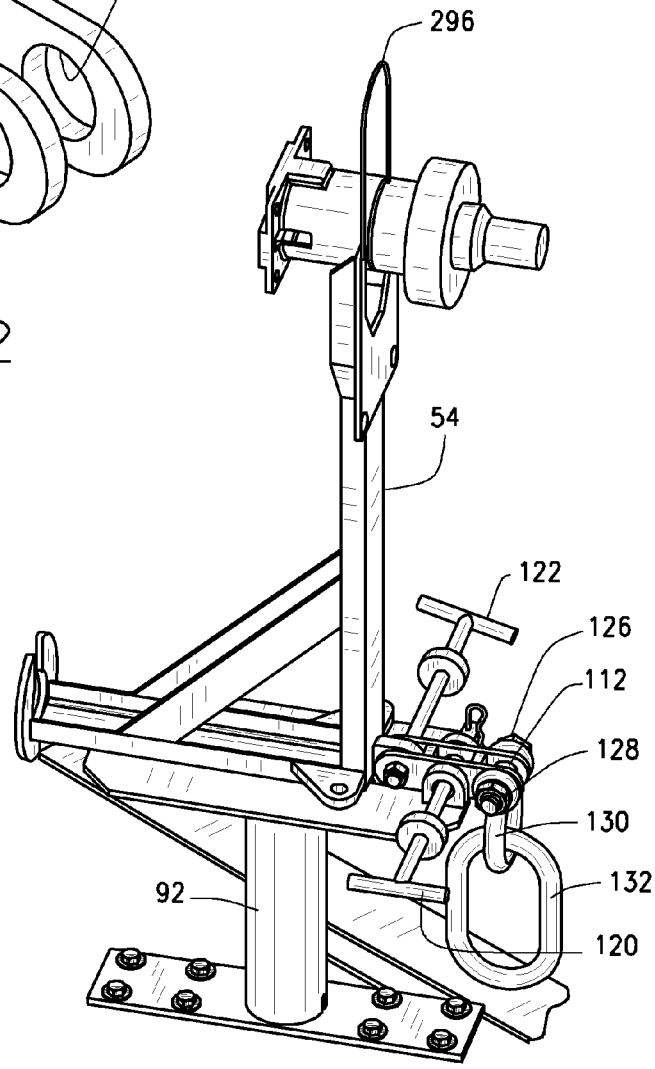
FIG. 13 is an enlargement of the first off cobra head assembly secured to its adjustable porch using the clevis of FIG. 12. As previously noted, the adjustable porch may also be slightly modified to receive cobra head assemblies from any vendor.
Figure 14:
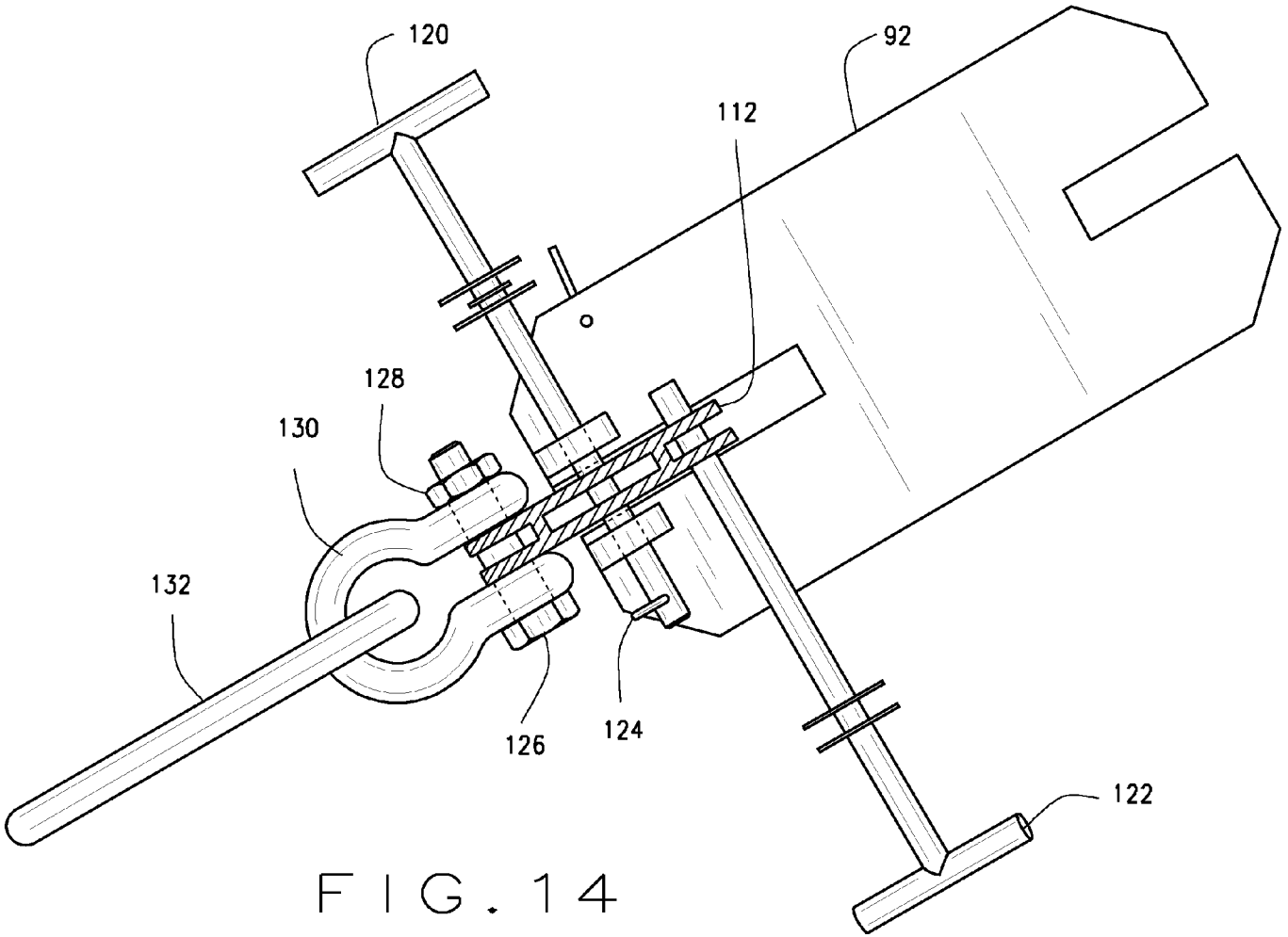
FIG. 14 is an enlargement of the clevis of FIG. 12, pins and the second porch that supports the first off cobra head assembly.
Figure 24:
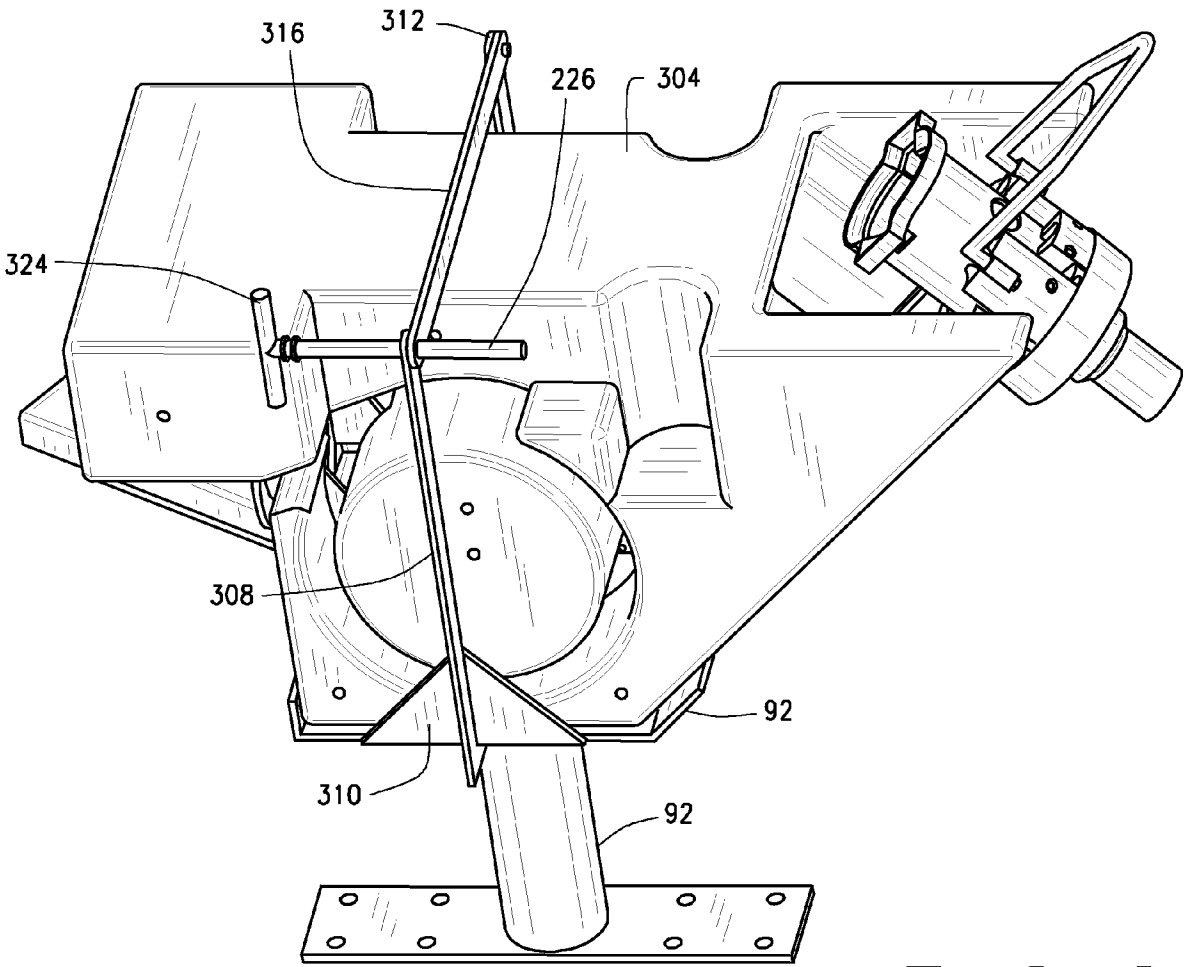
FIG. 24 is an enlargement of the removable support used with the flying lead with integral buoyancy system.
Figure 25:
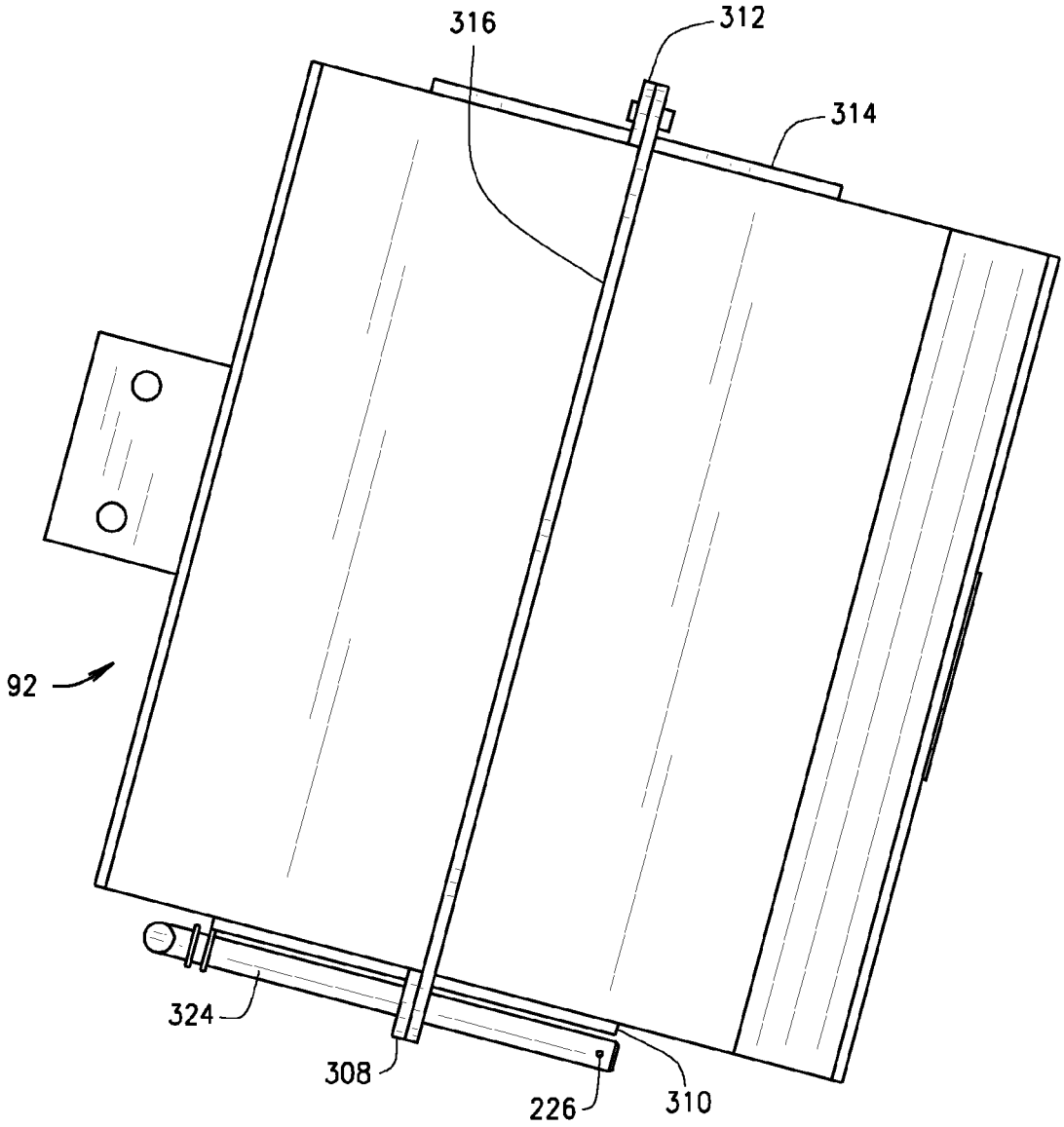
FIG. 25 is an enlargement of the first off cobra head with integral buoyancy secured to its adjustable porch. As previously noted, the adjustable porch may be slightly modified to receive cobra head assemblies from any vendor.

Referring now to FIGS. 24 and 25, a perspective view the second cobra head with integral buoyancy 304 mounted on the adjustable porch 92 is shown. The view in FIG. 23 is from the rear to better show the apparatus. A means for removably attaching the second cobra head with integral buoyancy to the adjustable porch is provided; this means for removably attaching the cobra heads does not require a clevis 112 as shown in FIG. 12 or the twin pin configuration of FIG. 13.

The means for removably attaching includes a first vertical bar 308 supported by stiffeners 310 welded or bolted to the floor 318 which is supported by a pedestal 328 connected to a foot 330. The foot has a plurality of holes 332 to facilitate adjustment of the porch on the cross brace 79. There is a need for adjustment because the end of the flying lead may be a few inches longer of shorter than specified. The adjustable porch allows accommodation on the mud mat for such manufacturing differences.

A second vertical bar 312 and other stiffeners 314 attach to the floor 318. A latch 316 is pivotally connected on one end to the second vertical bar 312. An aperture 320 is formed on the opposite end of the latch. Another aperture 322 of similar size is formed on the end of the vertical bar 308 opposite the connection to the floor. A pull pin is sized and arranged to fit through the first aperture 320 and the second aperture 322 to lock the late and thus removably secure the cobra head 304 to the adjustable porch 92. An aperture 326 is provided in the end of the pin opposite the T-shaped handle. As previously discussed, installers sometimes prefer different types of pins, such as cotter pins, hair pins and other means to secure the pin before the apparatus goes over the side.

A similar means for removably attaching the first cobra head 302 to the fixed porch 84 is also provided and shown in the following figures. The only difference is that the pull pin on the fixed porch 84 is in an opposite position to the porch 92.

Figure 26:
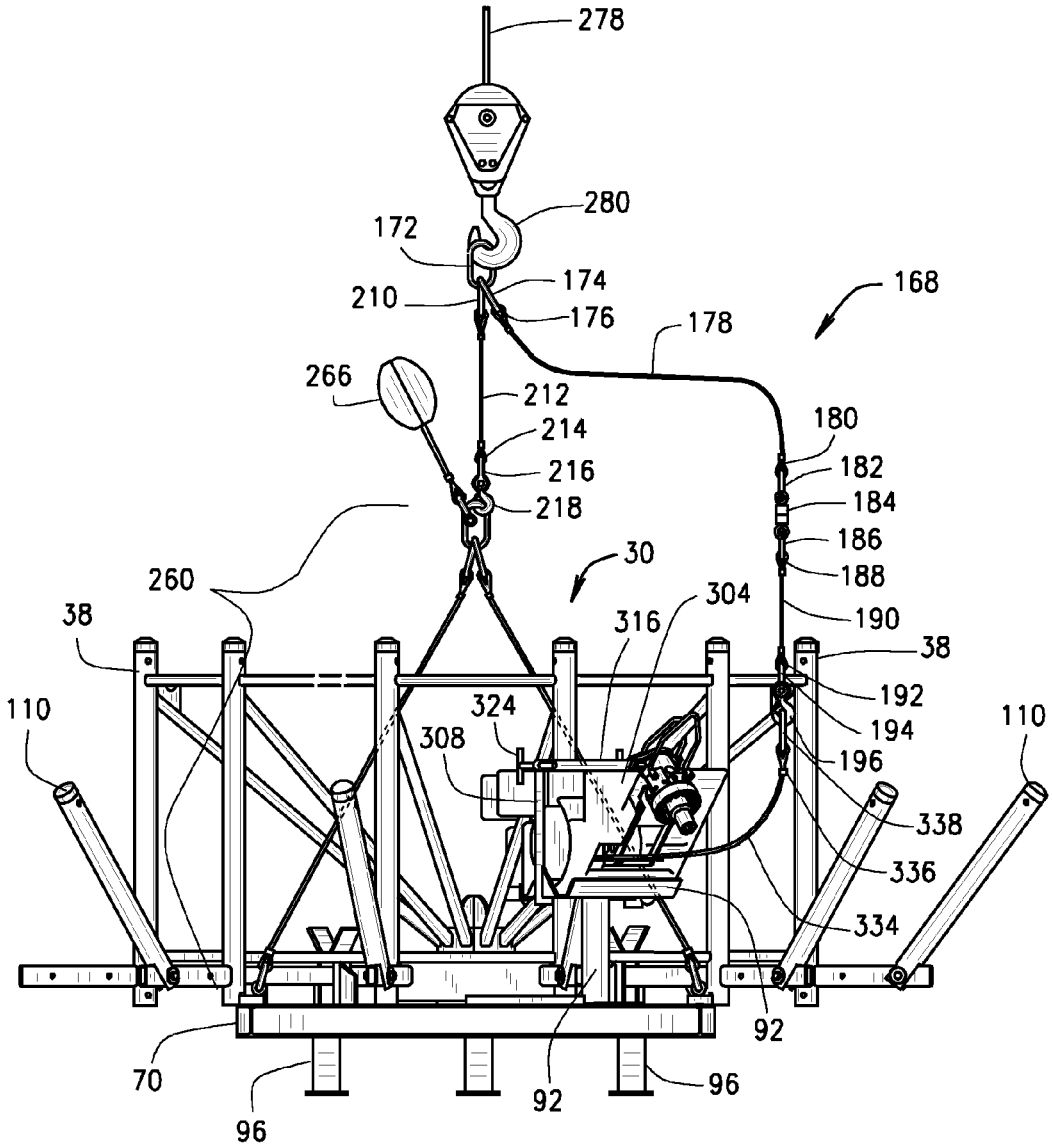
FIG. 26 is an elevation view of the subsea deployment system. The down line and ROV hook are attached to the master link. The first off cobra head assembly with an integral buoyancy module is mounted on its porch. The bundle for the flying lead has been omitted to better illustrate the apparatus.
Figure 27:
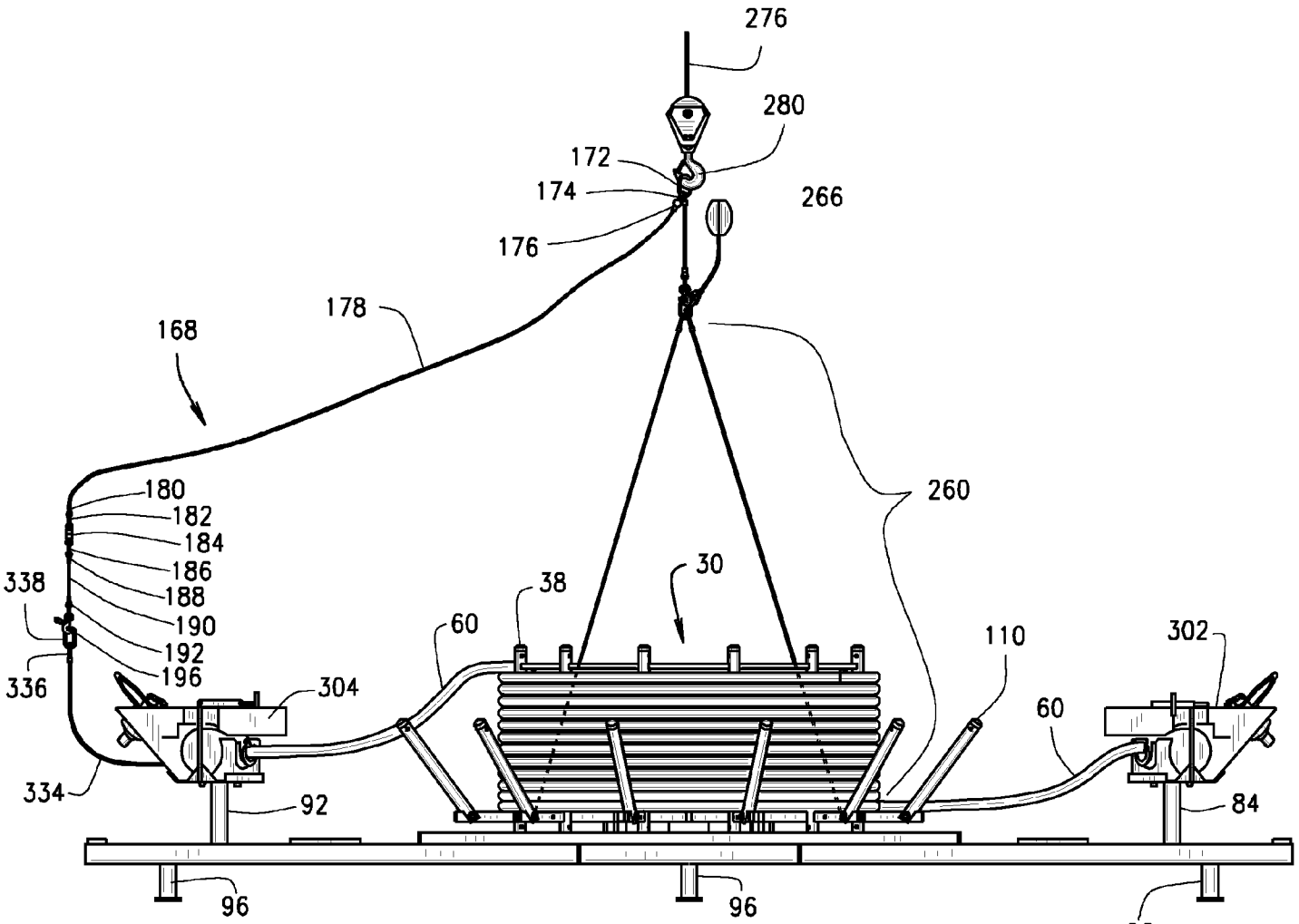
FIG. 27 is an elevation view of FIG. 25 from another angle, except the bundle has been added to better illustrate the subsea deployment system, just prior to going overboard.

Referring now to FIGS. 26 and 27, the apparatus is ready to go overboard. In these views, the buoyancy cages 80 and 82 have been removed from the figure solely for illustrative purposes, to better show the rigging. In FIG. 26, the bundle 60 has been removed for illustrative purposes to better show the mud mat sling assembly 260 and the individual components of the installation sling assembly 168, better seen in FIG. 16. The cobra head 304 with integral buoyancy includes a cable 334, a thimble-eye 336 and a link 338 which connects to the ROV hook 196. Release of the ROV hook 196 releases the cobra head 304 with integral buoyancy. In these views, the flotation module 266 is shown in an upright position as though it is floating on water. In reality, the flotation module 266 would not be in the upright position until the apparatus was lowered below the surface of the sea 284.

Method of Deployment and Installation of Flying Leads Having Separate Buoyancy as Shown in FIG. 1-20

A. In the Shop

1. The first buoyancy module is secured in the first buoyancy cage on the mud mat. The second buoyancy module is secured in the second buoyancy cage on the mud mat.

2. An empty cartridge, such as shown in FIG. 1 is located on the shop floor. A flying lead is positioned near the empty cartridge. The flying lead includes a first cobra head on one end of the bundle and a second cobra head on the other end of the bundle.

3. Using a horizontal drive unit the bundle is wound about the cartridge.

4. Using a, crane the first cobra head is lifted and attached to the fixed cobra support on the cartridge.

5. Using the crane, the bundle is wound about the cartridge and the second cobra head is attached to the adjustable cobra support. The adjustable cobra support is then removed from the cartridge. The cartridge with flying lead, as shown in FIG. 5, is now ready for transport to a dock or elsewhere.

B. On the Ship

1. At least one mud mat should be loaded on the ship and at least one cartridge with flying lead is also loaded on the ship. Alternatively, a cartridge may be attached to the mud mat and this subsea deployment system is loaded on the ship. Several additional cartridges with flying leads may also be loaded on the ship for a multiple lay job. The first order of business is to attach the cable from a crane to the plurality of lift eyes on the cartridge with flying lead. The cartridge is lifted over the mud mat as shown in FIG. 9. The cartridge is carefully lowered into place on the mud mat so a) the hub on the cartridge engages the stabilizer pin on the mud mat and b) the cartridge connectors engage the mud mat connectors. These connectors are bolted or otherwise secured so the cartridge and mud mat are firmly attached.

2. The first cobra head is detached from the fixed support on the cartridge and using a crane is attached to the first porch on the mud mat. A pull pin passes through the clevis and the eye on the porch to releasably attach the first cobra head to the first porch on the mud mat. The second cobra head is detached from the adjustable support on the cartridge and using the crane is attached to the second porch on the mud mat using a pull pin.

3. The angled supports are attached to the fixed horizontal spokes on the mud mat. There is no particular order when the angled supports are attached to the fixed horizontal spokes on the mud mat, but they should be attached before the apparatus goes overboard.

4. There is no particular order to the attachment of the rigging. The mud mat sling assembly is connected to the plurality of mud mat eyes. The master link of the installation sling assembly is connected to the ROV hook on the down line, and the short leg is attached to mud mat sling link. The long leg is attached to the link on the clevis. This is often called the "first off" cobra in the industry. The first buoyancy sling assembly is connected to the handle on the first cobra head and the buoyancy module eye on the first buoyancy module. The second buoyancy sling assembly is connected to the handle on the second cobra head and the buoyancy module eye on the second buoyancy module. The second cobra head is often called the "first off" in the industry because it is the first off the cartridge subsea. FIG. 18 shows all the rigging properly assembled before the apparatus goes overboard.

C. In the Water

1. FIG. 19 shows the apparatus going overboard. The down line pays in to lift the mud mat and cartridge off the deck of the ship. The apparatus is swung over the side and the down line pays out to lower the mud mat and cartridge to a predetermined location on the sea floor.

2. Once on the seafloor, a ROV disconnects the short leg of the installation sling assembly from the mud mat sling link. The mud mat sling assembly then sinks of its own weight down into the cartridge and the buoyancy module of the mud mat sling assembly hovers just above the cartridge. The ROV removes the ROV hair pin and then pulls the pin that is locking the second buoyancy module in the second cage. The second buoyancy module then floats free of the cage. The ROV pulls the pin that is locking the second cobra head on the second adjustable porch on the mud mat. As the down line pays in, it unwinds the bundle from the cartridge as shown in FIG. 20. The flying lead hangs vertically in the water column as the down line pays in. The second cobra head is called the "first off" because it is removed from the cartridge first subsea. Care must be taken to leave enough slack in the flying lead so that in the event that the boat heaves there will be no tension in the flying lead as the first cobra is still pinned to the mud mat.

3. The ROV removes the ROV hair pin and then pulls the pin that is locking the first cobra head on the first porch on the mud mat.

4. The ship repositions and lays the flying lead enroute. The first cobra head is either wet parked or installed on a piece of subsea equipment. The remaining description will assume that the first cobra has been installed on a piece of subsea equipment.

5. The down line pays out as the ship moves on the lay route. The second cobra head is then connected or wet parked in place.

6. The ROV disconnects the first buoyancy module from the first cobra and flies the first buoyancy module back to the cage. The short leg of the buoyancy sling assembly is ROV hooked to one of the two handles on the first cage, thus securing the first buoyancy module back on the mud mat. The ROV disconnects the second buoyancy module from the second cobra head and flies the second buoyancy module back to its cage. The short leg of the buoyancy sling assembly is hooked to one of the two handles on the second cage, thus securing the first buoyancy module to the mud mat.

7. The ROV disconnects the long leg of the installation sling assembly from the first cobra head. The short leg of the installation sling is reattached to the mud mat sling link. The down line pays in to recover the empty cartridge and mud mat back to the deck of the ship.

8. In the case of multiple lays, the empty cartridge is removed from the mud mat. A new cartridge is installed on the mud mat as shown in FIG. 10. The cycle then repeats.

Method of Deployment and Installation and Installation of Flying Leads Having Integral Buoyancy as Shown in FIG. 21-27.

A. In the Shop

1. An empty cartridge, such as shown in FIG. 1 is located on the shop floor. A flying lead is positioned near the empty cartridge. The flying lead includes a first cobra head with integral buoyancy on one end of the bundle and a second cobra head with integral buoyancy on the other end of the bundle.

2. Using a, crane the first cobra head is lifted and attached to the fixed cobra support on the cartridge.

3. Using a horizontal drive unit, the bundle is wound about the cartridge.

4. Using the crane, the bundle is wound about the cartridge and the second cobra head is attached to the adjustable cobra support. The adjustable cobra support is then removed from the cartridge. The cartridge with flying lead, as shown in FIG. 5, is now ready for transport to a dock or elsewhere.

B. On the Ship

1. At least one mud mat should be loaded on the ship and at least one cartridge with flying lead is also loaded on the ship. Alternatively, the cartridge may be loaded on the mud mat before being loaded on the boat. The first order of business is to attach the cable from a crane to the plurality of lift eyes on the cartridge with flying lead. The cartridge is lifted over the mud mat as shown in FIG. 9. The cartridge is carefully lowered into place on the mud mat so a) the hub on the cartridge engages the stabilizer pin on the mud mat and b) the cartridge connectors engage the mud mat connectors. These connectors are bolted or otherwise secured so the cartridge and mud mat are firmly attached.

2. The first cobra head is detached from the fixed support on the cartridge and using a crane is attached to the first porch on the mud mat. A pull pin passes through the clevis and the eye on the porch to releasably attach the first cobra head to the first porch on the mud mat. The second cobra head is detached from the adjustable support on the cartridge and using the crane is attached to the second porch on the mud mat using a pull pin.

3. The angled supports are attached to the fixed horizontal spokes on the mud mat. There is no particular order when the angled supports are attached to the fixed horizontal spokes on the mud mat, but they should be attached before the apparatus goes overboard.

4. There is no particular order to the attachment of the rigging. The mud mat sling assembly is connected to the plurality of mud mat eyes. The master link of the installation sling assembly is connected to the ROV hook on the down line, and the short leg is attached to mud mat sling link. The long leg is attached to the clevis. This is often called the "first off" cobra in the industry. The second cobra head is often called the "first off" because it is the first off the cartridge subsea. FIG. 18 shows all the rigging properly assembled before the apparatus goes overboard.

C. In the Water

1. FIG. 19 shows the apparatus going overboard. The down line pays in to lift the mud mat and cartridge off the deck of the ship. The apparatus is swung over the side and the down line pays out to lower the mud mat and cartridge to a predetermined location on the sea floor.

2. Once on the seafloor, a ROV disconnects the short leg of the installation sling assembly from the mud mat sling link. The mud mat sling assembly then sinks of its own weight down into the cartridge and the buoyancy module of the mud mat sling assembly hovers just above the cartridge. The ROV removes the ROV hair pin and then pulls the pin that is locking the second cobra head on the second adjustable porch on the mud mat. As the down line pays in, it unwinds the bundle from the cartridge as shown in FIG. 20. The flying lead hangs vertically in the water column as the down line pays in. The second cobra head is called the "first off" because it is removed from the cartridge first subsea. Care must be taken to leave enough slack in the flying lead so that in the event that the boat heaves there will be no tension in the flying lead as the first cobra is still pinned to the mud mat.

3. The ROV removes the ROV hair pin and then pulls the pen that is locking the first cobra head on the first porch on the mud mat.

4. The ship repositions itself to the subsea equipment that the first cobra head will engage. The cobra head may then be wet marked, installed or secured by clump weights to that position.

5. The ship then repositions to lay the flying lead enroute in a predetermined location on the seafloor. During this repositioning, the down cable pays out to lower the flying lead to the seafloor in a predetermined route. The second flying lead may be attached to a piece of subsea equipment or it may be wet parked.

6. The ship then repositions over the cartridge and mud mat.

7. The ROV disconnects the long leg of the installation sling assembly from the first cobra head. The short leg of the installation sling is reattached to the mud mat sling link. The down line pays in to recover the empty cartridge and mud mat back to the deck of the ship.

8. In the case of multiple lays, the empty cartridge is removed from the mud mat. A new cartridge is installed on the mud mat as shown in FIG. 10. The cycle then repeats.

What is claimed is:

1. In combination a removable cartridge and mud mat for deployment of at least one flying lead, the combination comprising:

a removable cartridge to receive at least one flying lead having a first cobra head on one end of a bundle and a second cobra head on the other end of the bundle, the removable cartridge having;

a centrally located hub to assist in proper location of the removable cartridge on the mud mat;

a plurality of uprights in a generally circular pattern about which the bundle is wound on the removable cartridge;

a first support to attach the first cobra head to the removable cartridge during transit;

a second adjustable support to attach the second cobra head to the removable cartridge during; and a plurality of moveable angled supports surrounding at least a portion of an outer circumference of the removable cartridge;

the mud mat sized and arranged to receive and engage the removable cartridge, the mud mat having;

a centrally located stabilization pin to engage the centrally located hub on the removable cartridge to assist in proper orientation of the removable cartridge on the mud mat;

means for securing the removable cartridge to the mud mat;

a first fixed porch to secure the first cobra head;

means for removably attaching the first cobra head to the first fixed porch;

a second adjustable porch to secure the second cobra head;

means for removably attaching the second cobra head to the second adjustable porch;

a plurality of lifting eyes on the removable cartridge to facilitate installation of the removable cartridge on the mud mat and to facilitate detachment of the removable cartridge from the mud mat;

a plurality of eyes on the mud mat to engage a main sling assembly; and a plurality of feet extending from a frame of the mud mat to facilitate crawling under the mud mat while on board ship.

2. In combination a removable cartridge and mud mat for deployment of at least one flying lead, the combination comprising:

a removable cartridge to receive at least one flying lead having a first cobra head on one of a bundle and a second cobra head on the other end of the bundle, the removable cartridge having;

a centrally located hub to assist in proper location of the removable cartridge on the mud mat;

a plurality of uprights in a generally circular pattern about which the bundle is wound on the removable cartridge;

a first support to attach the first cobra head to the removable cartridge during transit;

a second adjustable support to attach the second cobra head to the removable cartridge during; and a plurality of moveable angled supports surrounding at least a portion of an outer circumference of the removable cartridge;

the mud mat sized and arranged to receive and engage the removable cartridge, the mud mat having;

a centrally located stabilization pin to engage the centrally located hub on the removable cartridge to assist in proper orientation of the removable cartridge on the mud mat;

means for securing the removable cartridge to the mud mat;

a first fixed porch to secure the first cobra head;

means for removably attaching the first cobra head to the first fixed porch;

a second adjustable porch to secure the second cobra head;

means for removably attaching the second cobra head to the second adjustable porch;

a pair of cages sized and arranged to each contain a releasable buoyancy module, each cage attached to the mud mat;

means for releasing the buoyancy modules from the cages;

a first buoyancy sling assembly having a first leg and a second leg;

the first leg attached on one end to the first cobra head and on the other end to the first buoyancy module;

the second leg attached on one end to a ROV hook and on the other end to the first buoyancy module; and the first leg and the second leg of the first buoyancy sling assembly joined together at a mid-section of the first leg allowing the ROV hook to hang free to secure the first buoyancy module to the first cage after subsea deployment of the first cobra head;

a second buoyancy sling assembly having a third leg and a fourth leg;

the third leg attached on one end to the second cobra head and on the other end to the second buoyancy module;

the fourth leg attached on one end to a ROV hook and on the other end to the second buoyancy module; and the third leg and the fourth leg of the second buoyancy sling assembly joined together at a mid-section of the third leg allowing the ROV hook to hang free to secure the second buoyancy module to the second cage after subsea deployment of the second cobra head.

3. In combination a removable cartridge, mud mat and installation sling assembly for deployment of at least one flying lead, the combination comprising:

a removable cartridge to receive at least one flying lead having a first cobra head on one of a bundle and a second cobra head on the other end of the bundle, the removable cartridge having;

a centrally located hub to assist in proper location of the removable cartridge on the mud mat;

a first support to attach the first cobra head to the removable cartridge during transit;

a second adjustable support to attach the second cobra head to the removable cartridge during transit of the removable cartridge while loaded with at least one flying lead;

a plurality of uprights in a generally circular pattern about which the bundle is wound on the removable cartridge;

a plurality of moveable angled supports surrounding at least a portion of an outer circumference of the removable cartridge; and a plurality of lifting eyes to facilitate installation of the removable cartridge on the mud mat and to facilitate detachment of the removable cartridge from the mud mat;

the mud mat sized and arranged to receive and engage the removable cartridge, the mud mat having;

a centrally located stabilization pin to engage the centrally located hub on the removable cartridge to assist in proper orientation of the removable cartridge on the mud mat;

means for securing the removable cartridge to the mud mat;

a first fixed porch to secure the first cobra head to the mud mat;

means for removably attaching the first cobra head to the first fixed porch;

a second adjustable porch to secure the second cobra head to the mud mat;

means for removably attaching the second cobra head to the second adjustable porch;

a plurality of eyes on the mud mat to engage a main sling assembly; and an installation sling assembly having;

a first leg of the installation sling assembly connected on one end to a master link and on the other end to the second cobra head;

a second leg of the installation sling assembly connected on one end to the master link and on the other end to a ROV hook, to disconnect the installation sling assembly from the main sling assembly;

a swivel positioned in the long leg between the master link and the second cobra head;

a pair of cages sized and arranged to each contain a releasable buoyancy module, each cage attached to the mud mat;

means for releasing the buoyancy modules from the cages;

a pair of releasable buoyancy modules, each sized and arranged to fit into a cage;

a first buoyancy sling assembly having a first leg and a second leg;

the first leg of the first buoyancy sling assembly attached on one end to the first cobra head and on the other end to the first buoyancy module;

the second leg of the first buoyancy sling assembly attached on one end to a ROV hook and on the other end to the first buoyancy module; and the first leg and the second leg of the first buoyancy sling assembly joined together at a mid-section of the first leg of the first buoyancy sling assembly allowing the ROV hook to hang free to secure the first buoyancy module to the first cage after subsea deployment of the first cobra head;

a second buoyancy sling assembly having a first leg and a second leg;

the first leg of the second buoyancy sling assembly attached on one end to the second cobra head and on the other end to the second buoyancy module;

the second leg of the second buoyancy sling assembly attached on one end to a ROV hook and on the other end to the second buoyancy module; and the first leg and the second leg of the second buoyancy sling assembly joined together at a mid-section of the first leg of the second buoyancy sling assembly allowing the ROV hook to hang free to secure the second buoyancy module to the second cage after subsea deployment of the second cobra head.

* * * * *